US007086426B2

(12) United States Patent
Magno, Jr. et al.

(10) Patent No.: US 7,086,426 B2
(45) Date of Patent: Aug. 8, 2006

(54) ERGONOMIC CABLE TIE INSTALLATION TOOL

(75) Inventors: Joey D. Magno, Jr., Cordova, TN (US); Brian A. Pope, Bartlett, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 298 days.

(21) Appl. No.: 10/614,435

(22) Filed: Jul. 7, 2003

(65) Prior Publication Data

US 2005/0005993 A1 Jan. 13, 2005

(51) Int. Cl.
*B21F 9/02* (2006.01)

(52) U.S. Cl. ..... 140/123.5; 140/93.2; 140/123.6

(58) Field of Classification Search ..... 140/93.2, 140/123.5, 123.6
See application file for complete search history.

(56) References Cited

U.S. PATENT DOCUMENTS

| | | | | |
|---|---|---|---|---|
| 3,157,361 | A | 11/1964 | Heard | |
| 3,735,784 | A * | 5/1973 | Obuch et al. | 140/93.2 |
| 4,083,497 | A | 4/1978 | Rosenberger | |
| 4,093,005 | A | 6/1978 | Eberhardt et al. | |
| RE29,973 | E | 4/1979 | Paradis | |
| 4,192,358 | A | 3/1980 | Bone | |
| 4,410,019 | A | 10/1983 | Suzuki | |
| 4,534,817 | A | 8/1985 | O'Sullivan | |
| 4,548,242 | A | 10/1985 | Paradis | |
| 4,609,149 | A | 9/1986 | Jessen | |
| 4,718,460 | A | 1/1988 | Sato | |
| 4,726,403 | A | 2/1988 | Young et al. | |
| 4,791,968 | A | 12/1988 | Pearson | |
| 4,793,385 | A | 12/1988 | Dyer et al. | |

(Continued)

FOREIGN PATENT DOCUMENTS

EP 0 299 387 A1 1/1989

(Continued)

OTHER PUBLICATIONS

Fiskars, "PowerGear Bypass Pruner", The Home Depot, before May 20, 2003 (approximately Feb. 2003), enlargement of illustration.

(Continued)

*Primary Examiner*—Lowell A. Larson
(74) *Attorney, Agent, or Firm*—Hoffmann & Baron, LLP

(57) ABSTRACT

An ergonomic cable tie installation tool includes a generally pistol-shaped housing including a grip which depends from a barrel. Pivotally connected to the lower region of the grip is a trigger linkage of a trigger mechanism. The trigger mechanism also includes an intermediate linkage pivotally connected to the trigger linkage. The intermediate linkage is supported in the housing. The intermediate linkage is, in turn, connected to a tensioning mechanism also supported in the housing. The tensioning mechanism couples the intermediate linkage to the cable tie. Pivoting the trigger linkage toward the grip, normally by the hand of a user, causes the intermediate linkage to pivot resulting in the tensioning mechanism producing an increased tension in the cable tie. The trigger linkage is oriented relative to the grip such that pivoting it toward the grip requires the stronger fingers of the user's hand to travel more than the weaker fingers thereby improving the ergonomics of the tool. The trigger linkage may also make the respective travel distances of the stronger and weaker fingers more uniform also improving the ergonomics of the cable tie installation tool. Moreover, the trigger mechanism may provide for the tension force applied to the cable tie to increase as the trigger linkage is increasingly pivoted toward the closed position. Methods of operating the tool also provide improved ergonomics of the tool.

26 Claims, 25 Drawing Sheets

U.S. PATENT DOCUMENTS

| | | | |
|---|---|---|---|
| D306,390 | S | 3/1990 | Dyer |
| 4,997,011 | A | 3/1991 | Dyer et al. |
| 5,176,327 | A | 1/1993 | Petersen et al. |
| 5,392,822 | A | 2/1995 | Kraus |
| 5,431,659 | A | 7/1995 | Ross, Jr. et al. |
| 5,492,156 | A | 2/1996 | Dyer et al. |
| 5,518,043 | A | 5/1996 | Cheung et al. |
| D370,962 | S | 6/1996 | Aquilina |
| 5,566,726 | A | 10/1996 | Marelin |
| 5,595,220 | A | 1/1997 | Leban et al. |
| 5,667,143 | A | 9/1997 | Sebion et al. |
| 5,769,133 | A | 6/1998 | Dyer et al. |
| 5,832,964 | A | 11/1998 | Joshi |
| 5,915,425 | A | 6/1999 | Nilsson et al. |
| 6,039,089 | A | 3/2000 | Kurmis |
| 6,047,741 | A | 4/2000 | Kurmis |
| D430,781 | S | 9/2000 | Hillegonds |
| 6,206,053 | B1 | 3/2001 | Hillegonds |
| 6,513,555 | B1 | 2/2003 | Lesser et al. |
| D491,430 | S | 6/2004 | Magno, Jr. et al. |
| 2005/0005993 | A1 | 1/2005 | Magno, Jr. et al. |

FOREIGN PATENT DOCUMENTS

| | | |
|---|---|---|
| EP | 1 108 649 | 6/2001 |
| GB | 1577957 | 10/1980 |
| GB | 2 240 601 A | 8/1991 |
| JP | 2000 168724 | 6/2000 |
| JP | 2000-168724 | 6/2000 |
| JP | 2002 321705 | 11/2002 |

OTHER PUBLICATIONS

Fiskars, "Ergonomics, The Development of Vineyard Cutting Tools", Aug. 29, 2003.

European Search Report, including Annex, attached to European Patent Office Communication dated Jan. 21, 2005 (5 pages).

Partial European Search Report for European Patent Application No. EP 05 07 5328, including Annex, Abstract, Lack of Unity of Invention-Sheet B dated Jun. 9, 2005 (4 pages).

Notification of Reason for Refusal, Japanese Patent Office, Japanese Patent Application No. 2004-200020, Dec. 19, 2005 (Japanese language, 2 pages, English language translation, 1 page).

* cited by examiner

17

ERGONOMIC CABLE TIE INSTALLATION TOOL

BACKGROUND OF THE INVENTION

The present invention relates generally to a cable tie installation tool, and more specifically, to such a tool having an ergonomic trigger mechanism.

As is well known to those skilled in the art, cable ties (or straps) are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage allowing the tail to be inserted through the passage but preventing retraction of the tail through the passage in the head. Two longitudinally separated portions of the tail are thereby secured to the head to define a loop for holding together the group of articles.

In practice, the installer manually places the tie about the articles to be bundled, inserts the tail through the head passage and then manually tightens the tie about the bundle. At this point, a cable tie installation tool is used to tension the cable tie. One type of such a cable tie installation tool includes a housing which is generally pistol-shaped where the housing has a barrel into which the tail may be inserted for application of the tension. The housing has a grip which depends from the barrel. The tool includes a trigger mechanism having a trigger member located under the barrel and in front of the grip. The trigger member is elongate and in generally depending relation relative to the barrel such that, when the heel of the hand of a user is placed against the grip such that the fingers of the user's hand extend forwardly, the fingers may encircle the forward surface of the trigger member. Forcibly drawing the fingers toward the heel of the hand, i.e., squeezing the trigger member and grip, causes the trigger member to be displaced toward the grip. The trigger mechanism extends into the housing and is able to grasp the tail, and to apply the predetermined tension thereto in proportion to the drawing or squeezing force applied to the trigger member.

The trigger member of such a cable tie installation tool is typically pivotally mounted adjacent to the barrel such that, when the trigger member is at the maximum displacement from the grip, the trigger member is inclined relative to the barrel and grip. This inclination results in the distance between the trigger member and grip being smallest adjacent to the barrel and increasing in the direction away from the barrel. This inclination is maximum when the trigger member is open prior to any squeezing thereof. The squeezing of the trigger member causes the trigger member to pivot toward the grip causing the angle between the trigger member and the grip to close.

The inclination of the trigger member prior to the squeezing thereof has ergonomic disadvantages. One such disadvantage is that the smaller fingers of the hand (i.e., the smallest and ring fingers) are more distant from the pivotal connection of the trigger member as compared to the larger fingers (i.e., the index and middle fingers). This relative distance is significant because the squeezing force applied to the trigger member is increasingly multiplied as the squeezing force is more distant from the pivotal connection. The squeezing force is translated, via the trigger mechanism, to the tension force applied to the cable tie.

Since the smaller fingers typically have less strength than the larger fingers, the force multiplication generated by the pivoting of the trigger member is less than it would be if the larger fingers were farther from the pivotal connection. If a substantial squeezing force is required to be applied to the trigger member, e.g., a substantial tension is required in the cable tie, then the smaller fingers may become strained. Alternatively, to generate such a substantial tension, the inclination of the trigger member may be increased to make greater the leverage of the trigger member. However, such an increase in the inclination would require the smaller fingers to extend farther to initially grasp the trigger member. This would normally be difficult due to the limited length of such fingers.

SUMMARY OF THE INVENTION

The ergonomic cable tie installation tool of the present invention includes a generally pistol-shaped housing including a grip which depends from a barrel. Pivotally connected to the lower region of the grip is a trigger linkage of a trigger mechanism. The trigger mechanism also includes an intermediate linkage to which the trigger linkage is connected. The intermediate linkage is supported in the housing. The intermediate linkage is, in turn, connected to a tensioning mechanism also supported in the housing. The tensioning mechanism couples the intermediate linkage to the cable tie. Pivoting the trigger linkage toward the grip, normally by the hand of a user, causes the intermediate linkage to pivot resulting in the tensioning mechanism producing an increased tension in the cable tie. The trigger linkage is oriented relative to the grip to provide several ergonomic advantages to the user's hand when grasping the trigger linkage and grip.

One ergonomic advantage of the tool is that, when the fingers of the user's hand grasp the trigger linkage, the larger fingers of the user's hand are more distant from the pivotal connection as compared to the smaller fingers. This increases the force multiplication provided by the trigger mechanism thereby increasing the tension force applied to the cable tie. Additionally, the longer fingers have a greater reach enabling the inclination of the trigger linkage to be increased providing the trigger linkage with greater leverage.

The trigger mechanism may be constituted by a single toggle mechanism. Additional embodiments include the trigger mechanism including a double or compound toggle mechanism. Such a mechanism has additional advantages including the capability to transmit larger tension forces to the cable tie with reduced angular displacements of the trigger linkage. Additionally, such a trigger mechanism may provide for the tension force applied to the cable tie to increase as the trigger linkage is increasingly pivoted toward the closed position. This is particularly advantageous because, typically, as the cable tie is stretched, it becomes increasingly resistant to continued stretching. Also, such a trigger mechanism may reduce the inclination of the trigger linkage relative to the grip so that squeezing of the trigger linkage results in more linear displacement of the trigger linkage relative to the grip.

Methods of operating the tool of the present invention also provide improved ergonomics of the tool.

These and other features of the invention will be more fully understood from the following description of specific embodiments of the invention taken together with the accompanying drawings.

BRIEF DESCRIPTION OF THE DRAWINGS

In the drawings.

Corresponding reference characters indicate corresponding parts throughout the several views of the drawings.

DETAILED DESCRIPTION OF THE INVENTION

Figure 1:
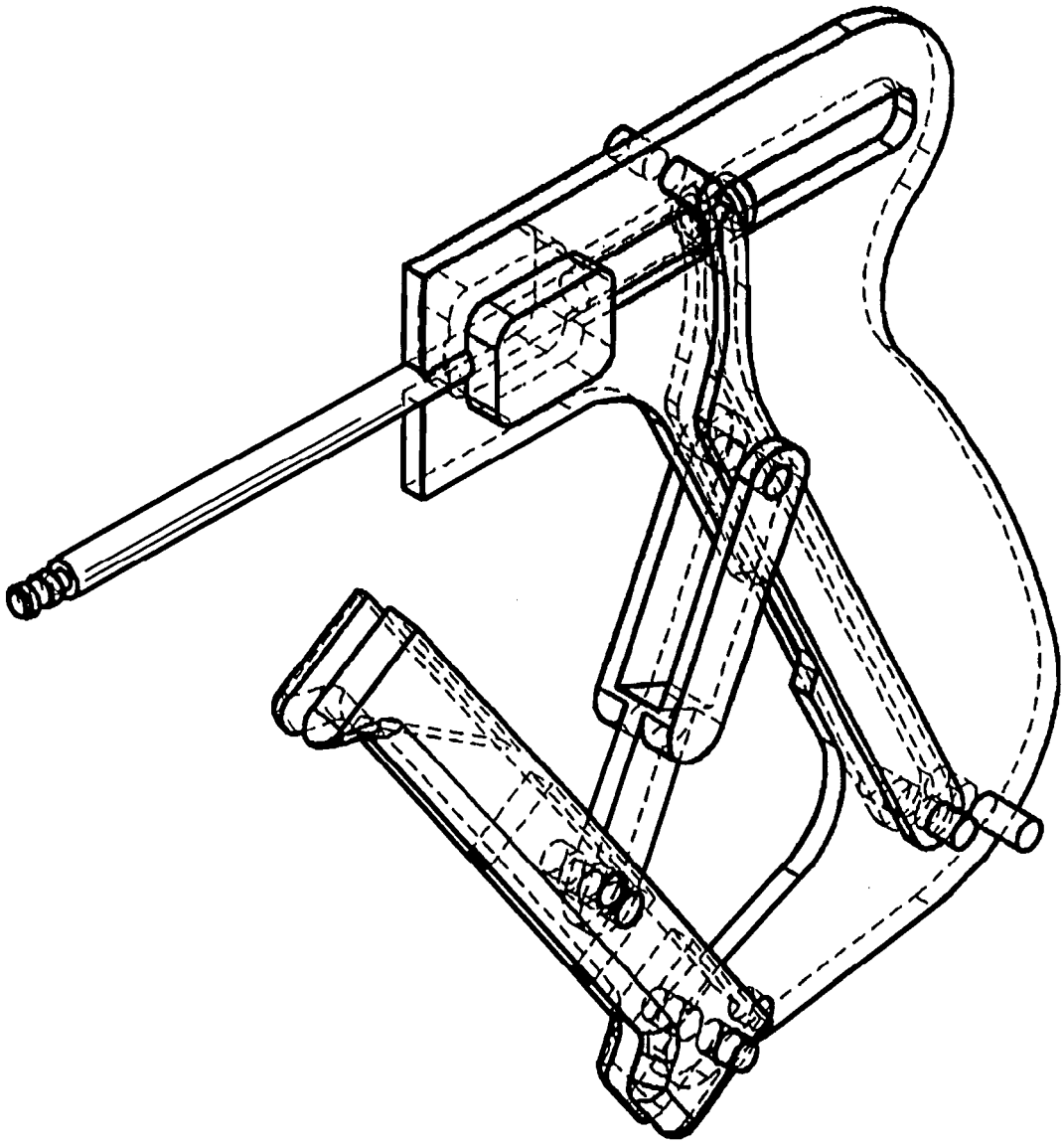
FIG. 1 is a perspective view of the ergonomic cable tie installation tool of the present invention with outer housing being removed to show the housing frame and trigger mechanism, the trigger mechanism being shown in the open position.

Referring to the drawings and more particularly FIGS. 1 to 6, an ergonomic cable tie installation tool 30 is shown for securing a cable tie to a bundle of articles, such as wires or cables.

The tool 30 includes a pistol-shaped housing including a grip which depends from a barrel. The housing includes an outer shell and may include an internal longitudinal planar frame which is centrally located within the outer shell. Such a housing frame is shown in FIGS. 1 to 6 and designated generally by the reference numeral 32. The housing frame 32 has a portion contained within the grip and is designated herein as the grip frame 34. The housing frame 32 has another portion contained within the barrel and is designated herein as the barrel frame 36.

The grip and barrel frames 34, 36 each have a respective longitudinal plane which define a central plane 38 of the housing. The grip and barrel, including their respective frames 34, 36, each have a longitudinal axis 40, 42 which is contained in the central plane 38. It is possible for the respective longitudinal axes 40, 42 of the grip and barrel to be offset from the central plane 38, as long as the axes are generally parallel to the central plane.

The barrel frame 36 has a distal end 44 and a longitudinal slot 46 which terminates at an opening 48 in the distal end. A grommet 50 is fixed to the barrel frame 36 near the distal end 44 in coaxial relation to the longitudinal slot 46 such that the slot extends through the grommet. A stop 52, which may be a pin, is transversely mounted on the barrel frame 36.

Figure 3:
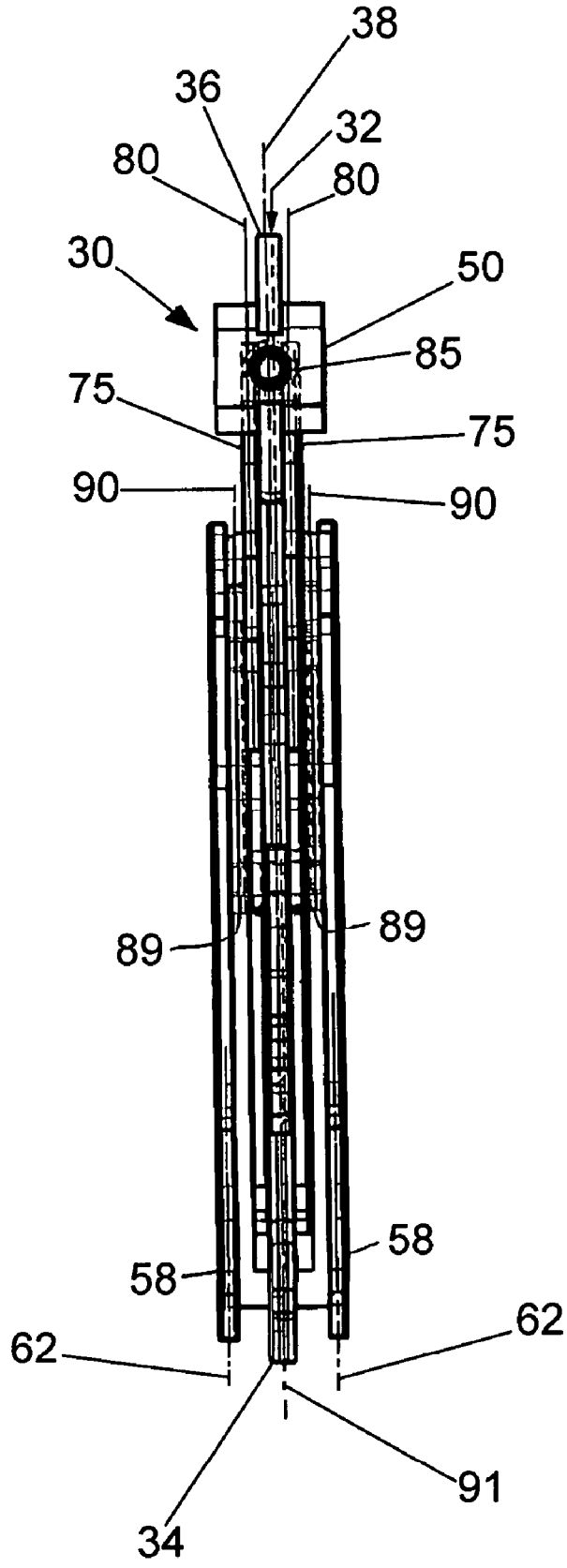
FIG. 3 is a front elevation view of the tool of FIG. 2 in the plane indicated by the line 3—3 of FIG. 2.
Figure 4:
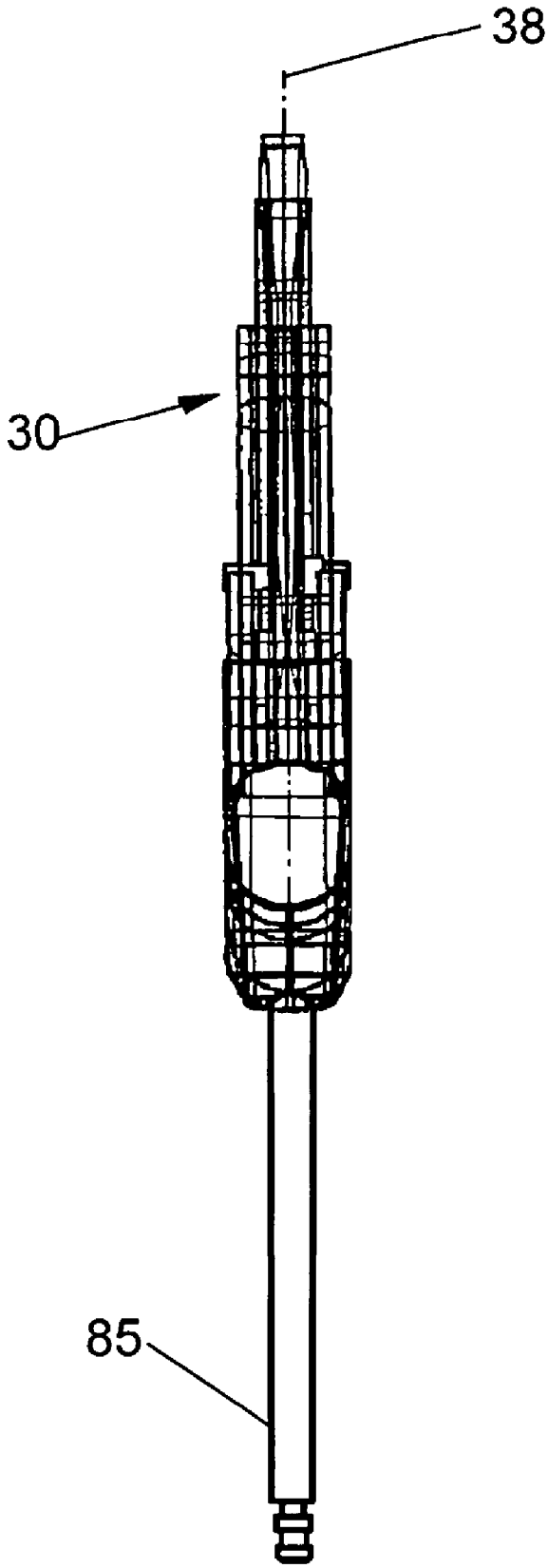
FIG. 4 is a top plan view of the tool of FIG. 2 in the plane indicated by the line 4—4 of FIG. 2.
Figure 5:
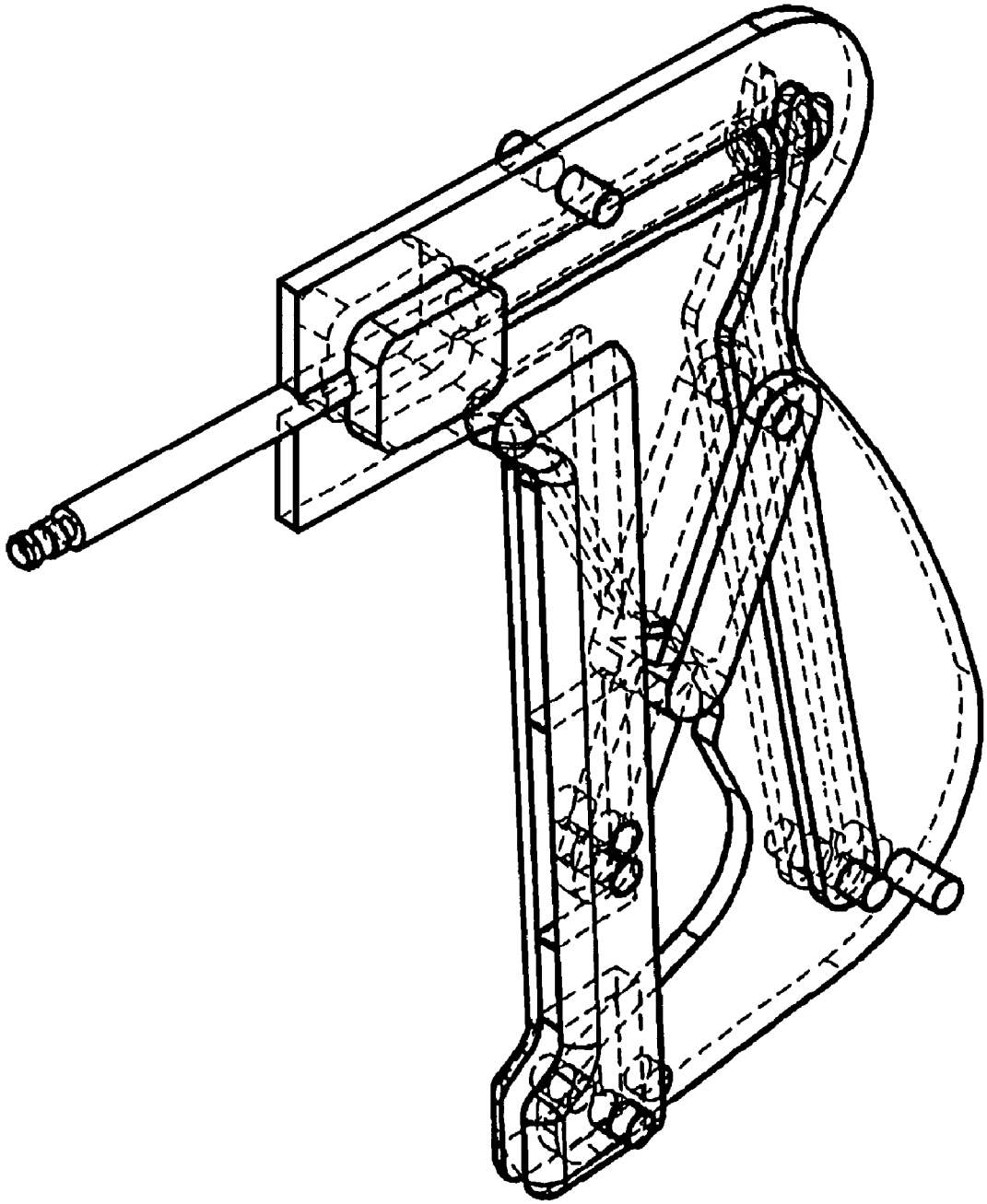
FIG. 5 is a perspective view of the tool of FIG. 1, with outer housing and barrel removed to show the housing frame and the trigger mechanism, the trigger mechanism being shown in the closed position.

The tool 30 includes a trigger mechanism 54 having a trigger linkage 56 with an elongate trigger member 58 having a dual-member structure, as shown in FIGS. 1 and 5. The respective members of the trigger member 58 each have one end which is pivotally connected to the grip frame 34 generally adjacent to the distal end 44. Each of the members of the trigger member 58 has a longitudinal axis 62 which is generally parallel to the central plane 38, as shown in FIG. 3. For clarity, the pair of members of the trigger member 58 will be referred to herein collectively as the trigger member 58.

As an alternative to the dual-member structure, the trigger member 58 may have a single-member structure having recesses to provide for the pivotal connections described herein. The longitudinal axis of the trigger member 58 having such a single-member structure may be generally contained in or parallel to the central plane 38.

Figure 2:
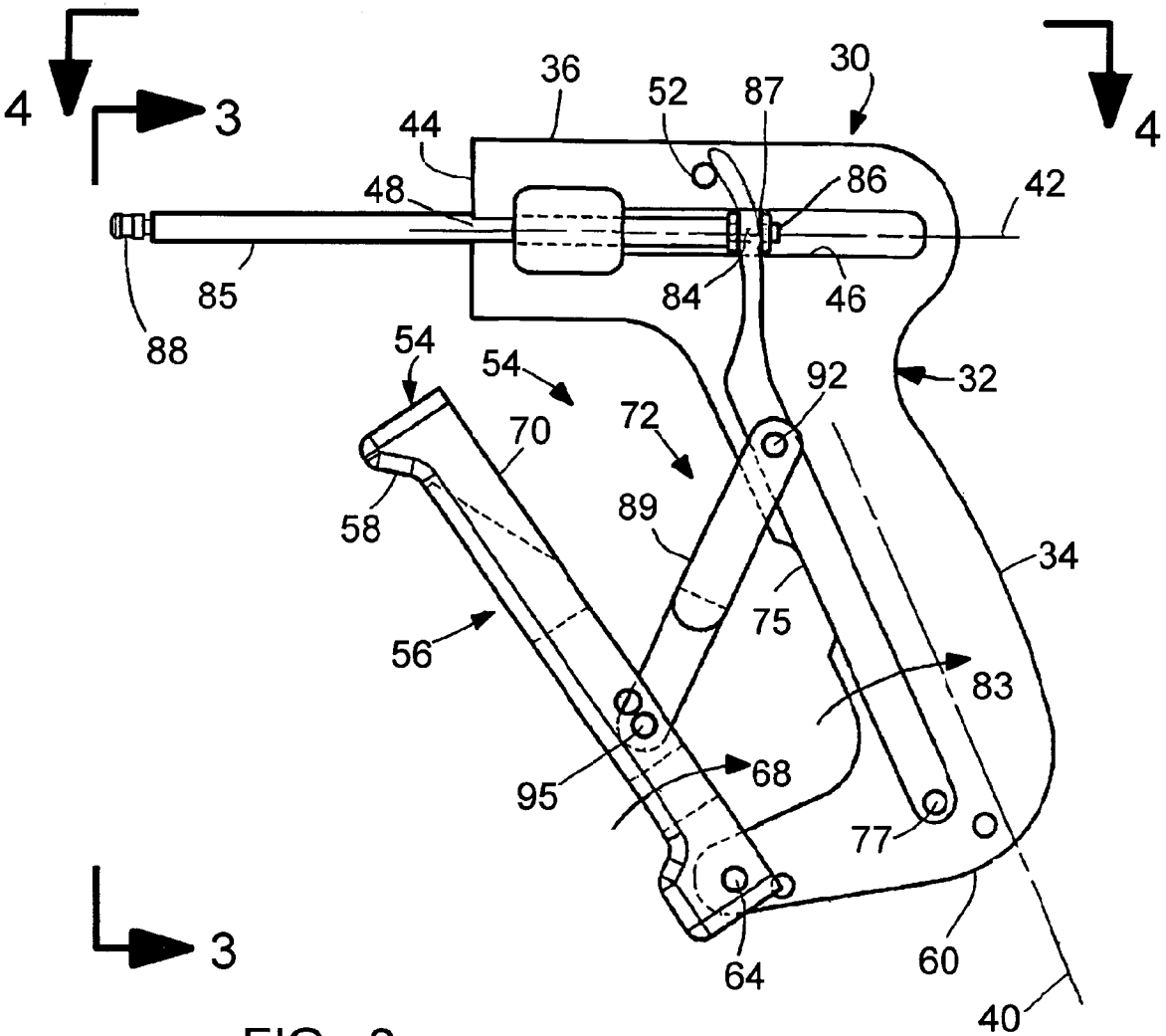
FIG. 2 is a side elevation view of the tool of FIG. 1.
Figure 6:
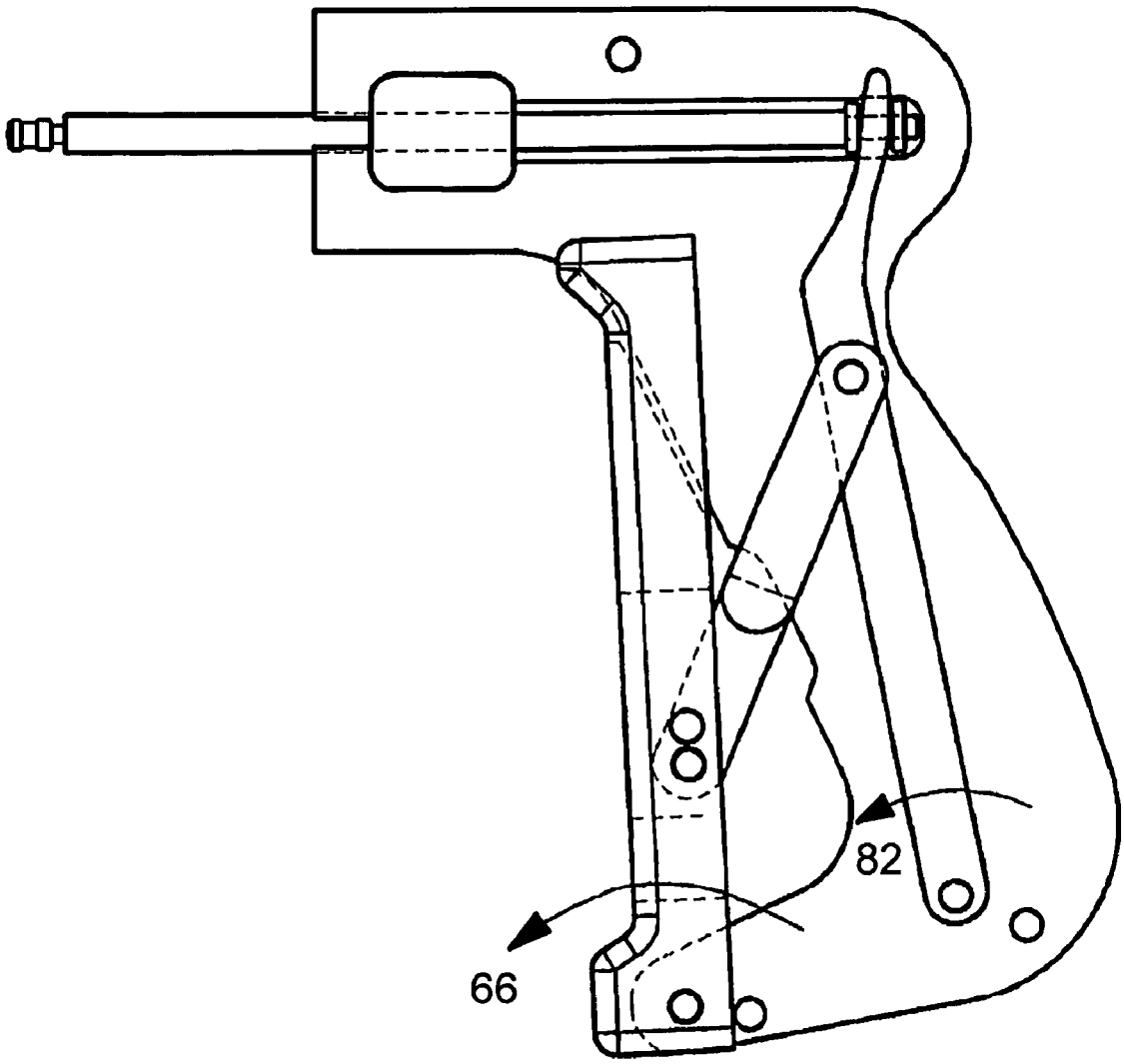
FIG. 6 is a side elevation view of the tool of FIG. 5.

The pivotal connections 64 between the trigger member 58 and grip frame 34 provides for pivoting of the trigger member in a direction 66 toward the open position shown in FIG. 2 and in a direction 68 toward the closed position shown in FIG. 6. The trigger member 58 has a distal region 70 the distance of which from the grip frame 34 is greater than the distance between the pivotal connections 64 and the grip frame when the trigger member 58 is in the open position shown in FIG. 2.

The trigger mechanism 54 includes an intermediate linkage 72 having an elongate finger member 75 with a dual-member structure, as shown in FIGS. 1 and 5. The respective members of the finger member 75 each have one end which is pivotally connected to the grip frame 34 generally adjacent to the distal end 60. Each of the members of the finger member 75 has a longitudinal axis 80 which is generally parallel to the central plane 38, as shown in FIG. 3. For clarity, the pair of members of the finger member 75 will be referred to herein collectively as the finger member 75.

As an alternative to the dual-member structure, the finger member 75 may have a single-member structure with recesses to provide for the pivotal connections described herein. The longitudinal axis of the finger member 75 having such a single-member structure may be generally contained in or parallel to the central plane 38.

The pivotal connections 77 provide for pivoting of the finger member 75 in a direction 82 toward the open position shown in FIGS. 1 and 2, in which the finger member abuts the stop 52, as shown in FIGS. 1 and 2. The pivotal connections 77 further provide for pivoting of the finger member 75 in a direction 83 toward a closed position shown in FIGS. 5 and 6. The finger member 75 has a sufficient longitudinal dimension to reach the stop 52 for engagement therewith when in the open position shown in FIGS. 1 and 2.

The other ends of the finger member 75 extend to the barrel frame 36 and across the slot 46. The other ends of the finger member 75 each have a detent 84 which extends to an axially-reciprocating pull rod 85 of a tensioning mechanism located in the slot 46. The pull rod 85 has a proximal end 86 including a catch 87 into which the detents 84 are inserted so that the detents are longitudinally fixed relative to the pull rod thereby axially displacing the pull rod in the slot 46 when the finger member 75 is pivoted in the direction 83 toward the closed position shown in FIGS. 5 and 6. Alternative embodiments are possible for longitudinally fixing the detents 84 to the pull rod 85, such as are disclosed in U.S. Pat. No. 5,915,425, the entire disclosure of which is hereby incorporated by reference herein.

The pull rod 85 extends from the proximal end 86, across the distal end 44 and opening 48, to a distal end 88 which is coupled to the cable tie by additional parts of the tensioning mechanism. Examples of mechanisms which may provide such coupling are disclosed in U.S. Pat. No. 5,915,425. The coupling between the distal end 88 and cable tie results in axial displacement of the pull rod 85 into the slot 46, as shown in FIGS. 5 and 6, resulting in the application of a tensile force to the cable tie.

The intermediate linkage 72 further comprises an elongate intermediate link 89 having one longitudinal portion with a dual-member structure and another longitudinal portion with a single-member structure. The portion of the intermediate link 89 having the dual-member structure is pivotally connected to the finger member 75, as shown in FIGS. 1, 2, 5 and 6. Each of the members of the dual-member structure of the intermediate link 89 has a longitudinal axis 90 which is generally parallel to the central plane 38, as shown in FIG. 3. The portion of the intermediate link 89 having the single-member structure is pivotally connected to the trigger member 58, as shown in FIGS. 1, 2, 5 and 6. The member of the single-member structure of the intermediate link 89 has a longitudinal axis 91 which is generally contained in the central plane 38. For clarity, the members of the portions of the intermediate link 89 will be referred to herein collectively as the intermediate link 89.

As an alternative to the combined single and dual-member structure of the intermediate link 89, the link may have a single-member structure throughout its length. The longitudinal axis of the intermediate link 89 having such a single-member structure may be generally contained in or parallel to the central plane 38. Alternatively, further, the intermediate link 89 may have a dual-member structure throughout its length. The longitudinal axes of the respective members of such an intermediate link 89 may be generally parallel to the central plane 38. Alternatively, still further, the intermediate link 89 may have other single- or dual-member structures in other assembly configurations.

The pivotal connections 92, 95 of the intermediate link 89 are offset from one another such that the intermediate link is inclined relative to the trigger and finger members 58, 75, as viewed in FIGS. 1, 2, 5 and 6.

The tool 30 may have additional parts such as are disclosed in U.S. Pat. No. 5,915,425.

In operation, initially, the trigger member 58 is pivoted in the direction 66 to the open position shown in FIGS. 1 and 2. The tail of the cable tie is coupled to the distal end 88 of the pull rod 85.

The user grasps the trigger member 58 and grip such that the fingers of the user's hand partially encircle the trigger member and the heel of the user's hand abuts the grip. The fingers are oriented along the trigger member 58 so that the smaller fingers are between the larger fingers and the pivotal connections 64.

The user's hand is then closed causing the trigger member 58 to pivot in the direction 68 toward the closed position shown in FIGS. 5 and 6. Closure of the trigger member 58 results in the travel of the larger fingers toward the grip being greater than the corresponding travel of the smaller fingers.

Pivoting of the trigger member 58 in the direction 68 to the closed position shown in FIGS. 5 and 6 causes the intermediate link 89 to pivot the finger member 75 in the direction 83 about the pivotal connections 77 toward the closed position shown in FIGS. 5 and 6. This pivoting of the trigger and finger members 58, 75 causes the intermediate link 89 to pivot relative to the trigger and finger members from the angular positions shown in FIGS. 1 and 2 toward those shown in FIGS. 5 and 6.

The pivoting of the finger member 75 in the direction 83 toward the closed position shown in FIGS. 5 and 6 causes the detents 84 to be translated longitudinally away from the distal end 44 of the barrel frame 36. This results in corresponding axially displacement of the pull rod 85 into the slot 46 which, due to the cable tie being coupled to the pull rod, applies a tensile force to the cable tie.

An alternative second embodiment of the cable tie installation tool **30*a* is shown in FIGS. 7 to 11. FIGS. 7 to 11 are views which correspond to the views of FIGS. 1 to 4, and 6, respectively. Parts illustrated in FIGS. 7 to 11 which correspond to parts illustrated in FIGS. 1 to 4, and 6 have, in FIGS. 7 to 11, the same reference numeral as in FIGS. 1 to 4, and 6** with the addition of the suffix "a".

The tool **30*a* includes an elongate outer trigger member 97. Accordingly, the trigger member 58*a* is referred to as the inner trigger member 58*a* of the tool 30*a*. The outer trigger member 97 has a dual-member structure, as shown in FIG. 7**.

Figure 9:
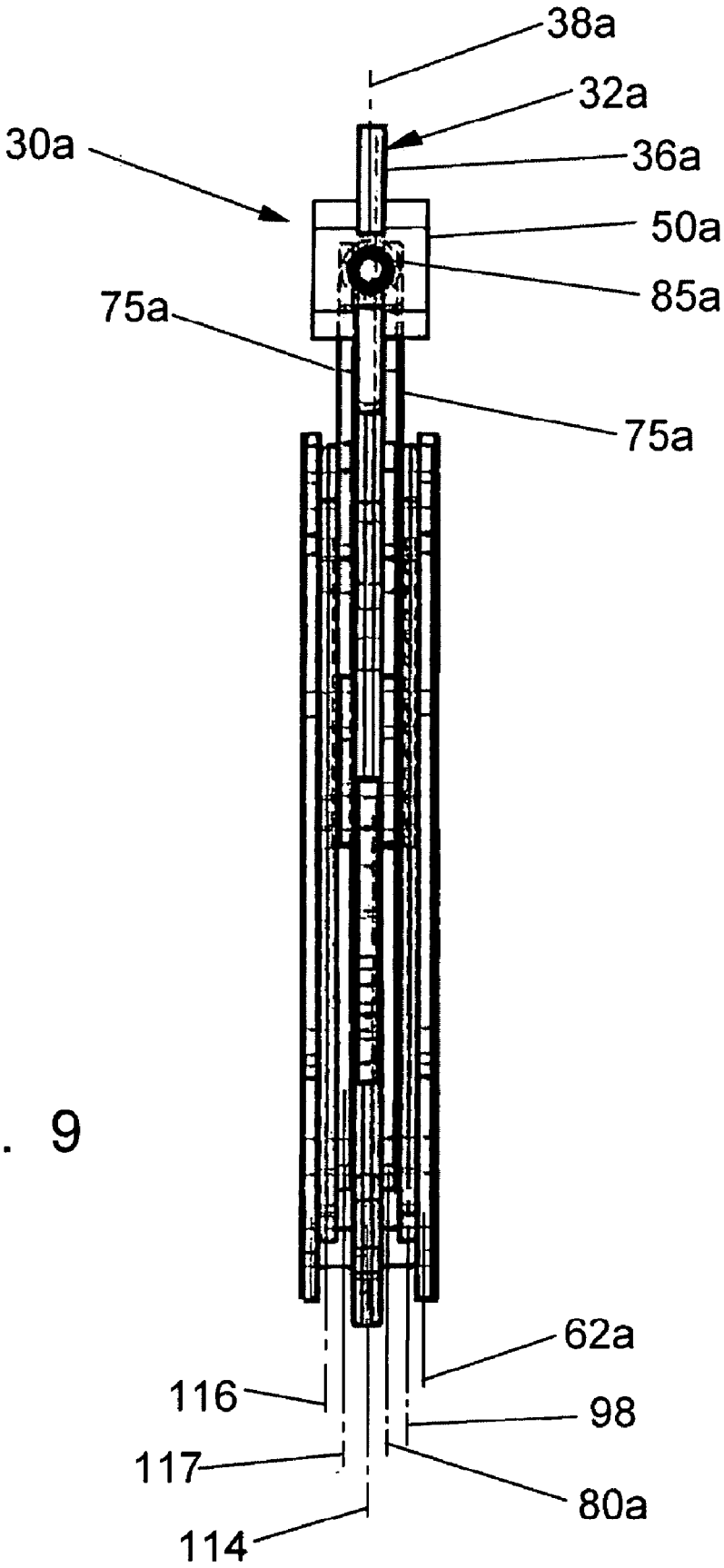
FIG. 9 is a front elevation view of the tool of FIG. 8 in the plane indicated by the line 9—9 of FIG. 8.
Figure 10:
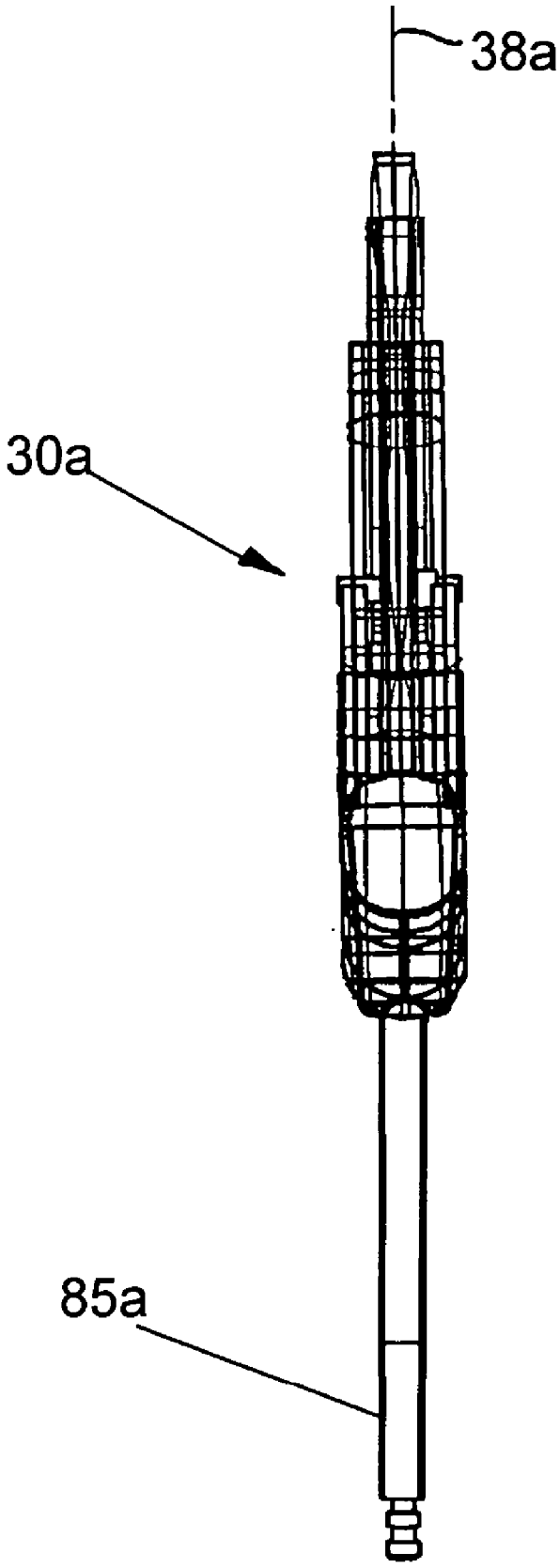
FIG. 10 is a top plan view of the tool of FIG. 8 in the plane indicated by the line 10—10 of FIG. 8.

The respective members of the trigger member 97 each have one end which is pivotally connected to an end of the respective members of the inner trigger member **58*a* which are opposite from the pivotal connections 64*a*. Each of the members of the trigger member 97 has a longitudinal axis 98 which is generally parallel to the central plane 38*a*, as shown in FIG. 9. For clarity, the pair of members of the trigger member 97 will be referred to herein collectively as the outer trigger member 97**.

As an alternative to the dual-member structure, the outer trigger member 97 may have a single-member structure with recesses to provide for the pivotal connections described herein. The longitudinal axis of the trigger member 97 having such a single-member structure may be generally contained in or parallel to the central plane 38*a*.

Figure 7:
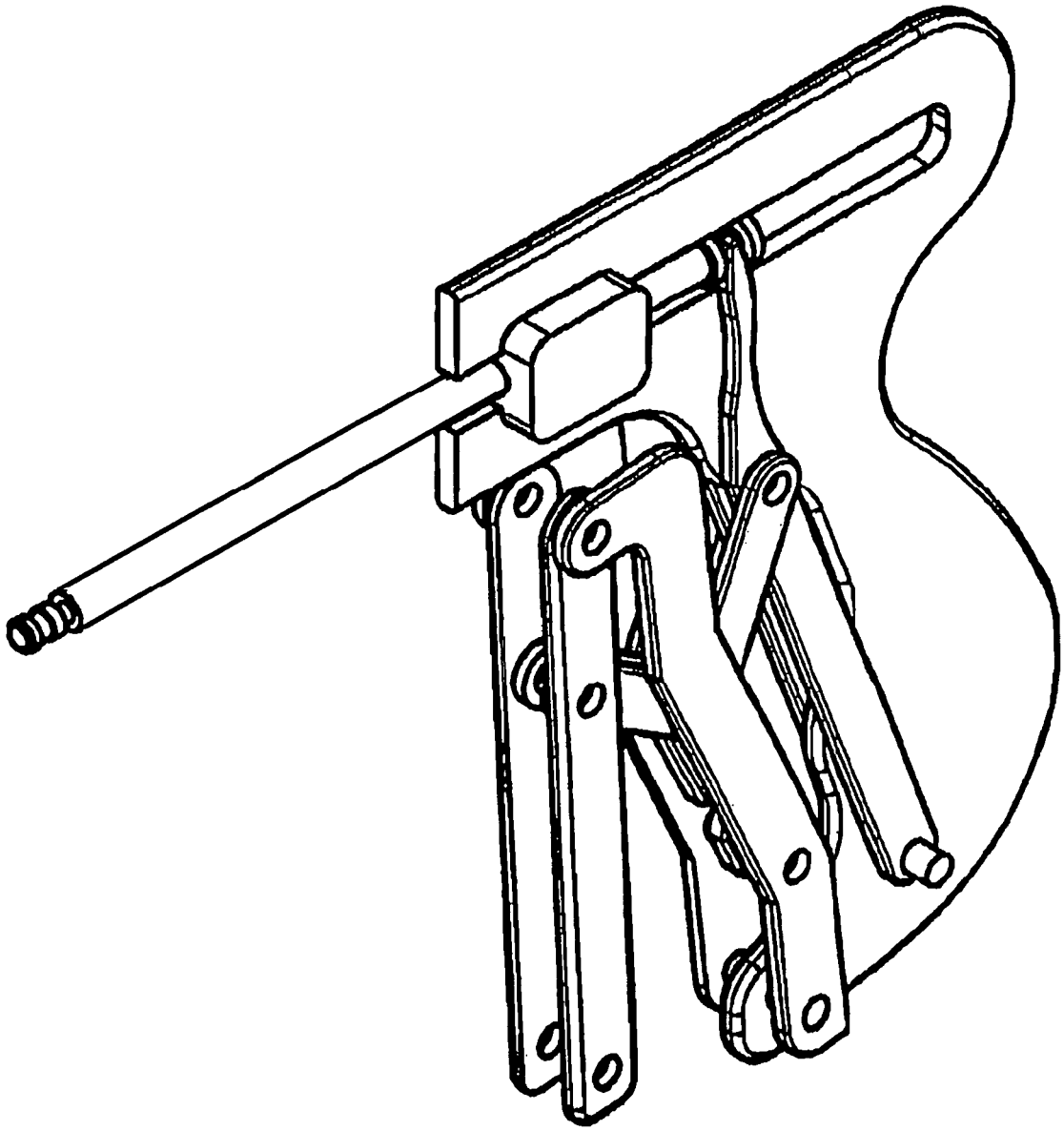
FIG. 7 is a perspective view of an alternative second embodiment of the tool of FIG. 1 with outer housing being removed to show the housing frame and trigger mechanism, the trigger mechanism being shown in the open position.
Figure 8:
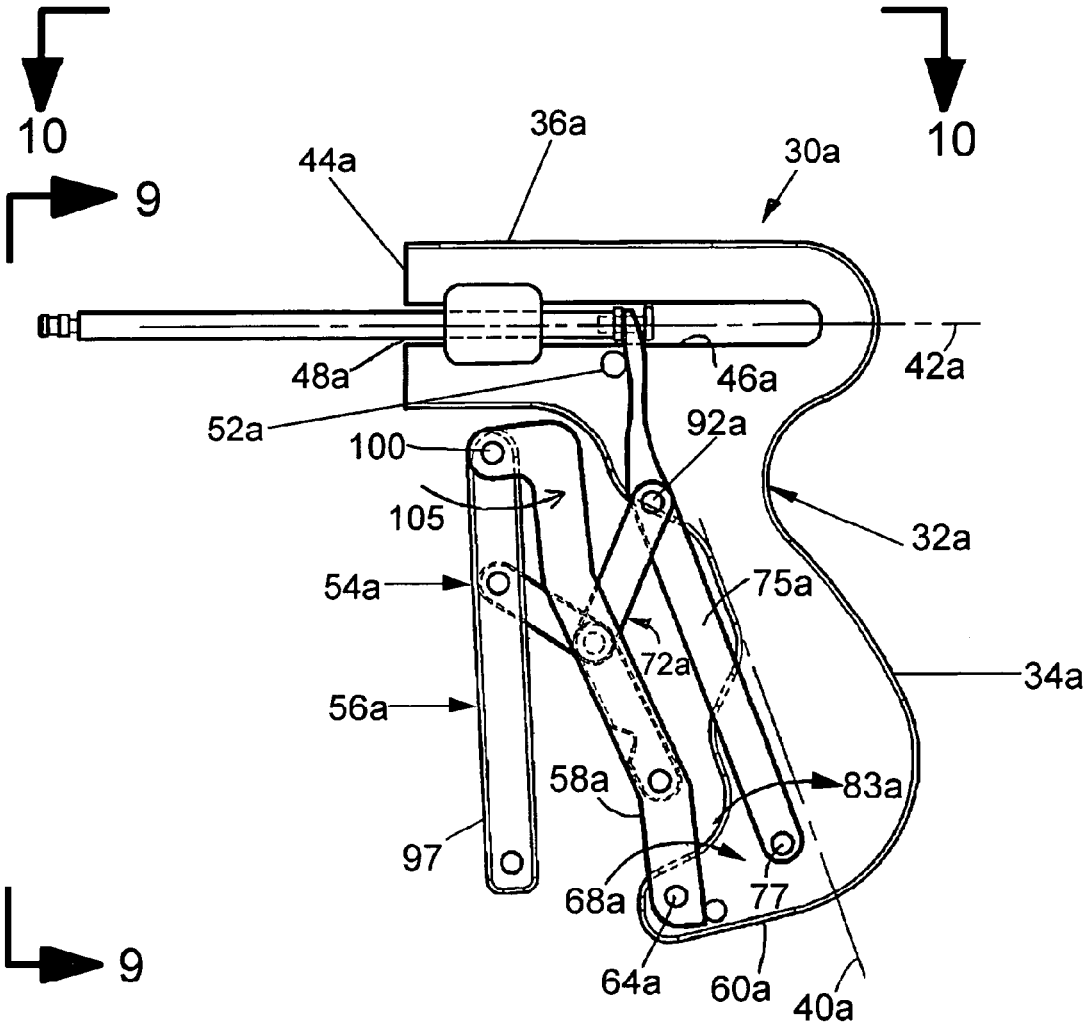
FIG. 8 is a side elevation view of the tool of FIG. 7, showing the trigger mechanism in the open position.

The pivotal connections 100 between the inner and outer trigger members 58*a*, 97 provides for the outer trigger member to pivot in a direction 102 toward the open position shown in FIGS. 7 and 8. The pivotal connections 100 further provide for pivoting of the outer trigger member 97 in a direction 105 toward the closed position shown in FIG. 11.

The intermediate linkage 72*a* comprises a central link 107 and inner and outer links 109, 111. The central link 107 has a single-member structure. The inner and outer links 109, 111 each have a dual-member structure, as shown in FIG. 7.

The respective members of the links 107, 109, 111 each have an inner end which is pivotally connected to a respective inner end the members of the other links at a pivotal connection 112 such that the links have a generally Y-shaped configuration when the trigger members 58*a*, 97 are each in the respective open positions shown in FIGS. 7 and 8. The central link 107 has a longitudinal axis 114 which is generally contained in the central plane 38*a*, as shown in FIG. 9. Each of the members of the inner and outer links 109, 111 has a respective longitudinal axis 116, 117 which is generally parallel to the central plane 38*a*. For clarity, the pairs of members of the inner and outer links 109, 111 will be collectively referred to herein as the inner link 109, and outer link 111, respectively.

As an alternative to the single-member structure, the central link 107 may have a dual-member structure. As an alternative to the dual-member structure, one or more of the inner and outer links 109, 111 may have a single-member structure. The longitudinal axes of any of the links 107, 109, 111 having such structures may be generally contained in or parallel to the central plane 38*a*.

The central link 107 has an outer end pivotally connected to the inner trigger member 58*a*. The inner link 109 has an outer end pivotally connected to the finger member 75*a*. The outer link 111 has an outer end pivotally connected to the outer trigger member 97.

Figure 11:
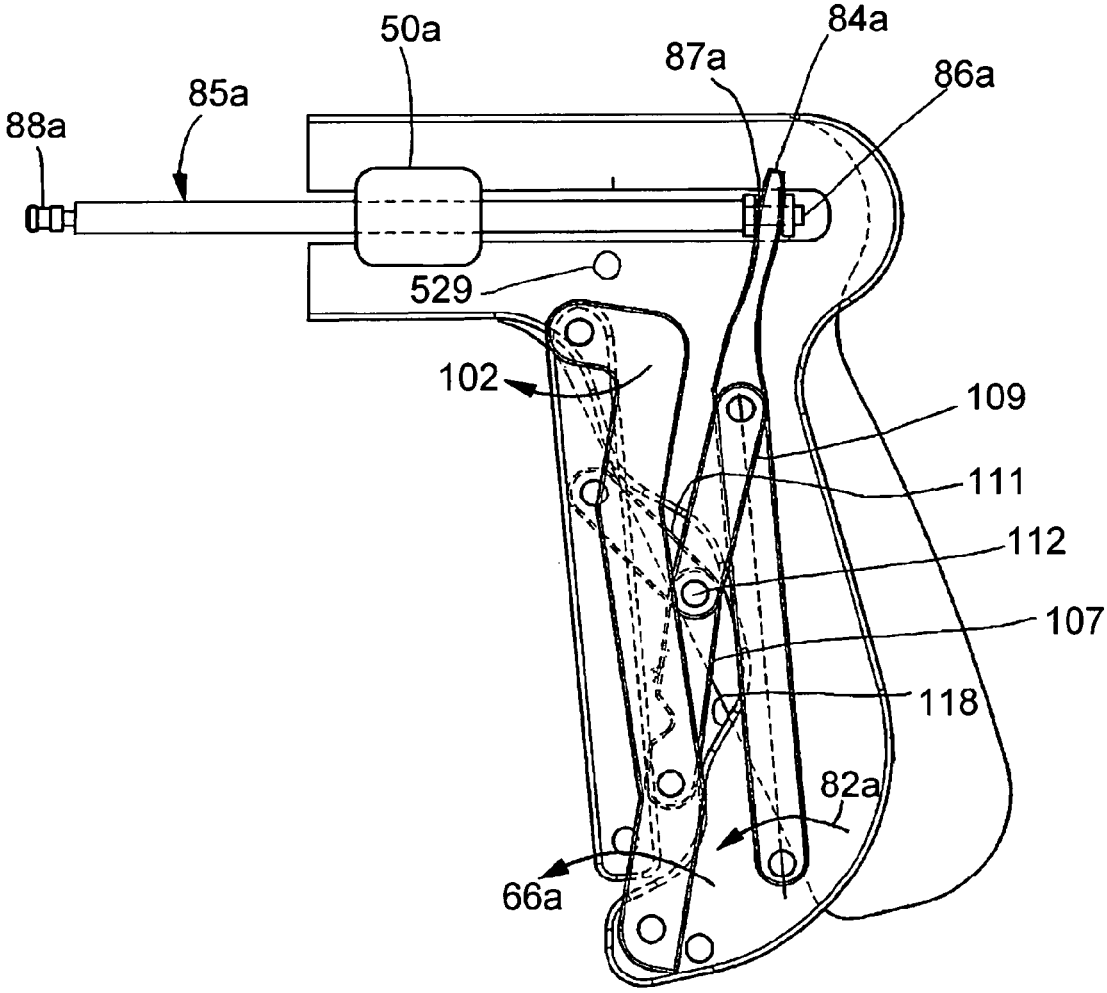
FIG. 11 is a side elevation view of the tool of FIG. 7, showing the trigger mechanism in the closed position.
Figure 15:
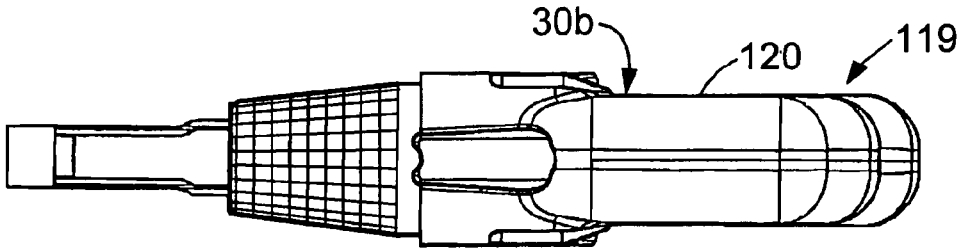
FIG. 15 is a top plan view of the tool of FIG. 12 in the plane indicated by the line 15—15 of FIG. 12.
Figure 12:
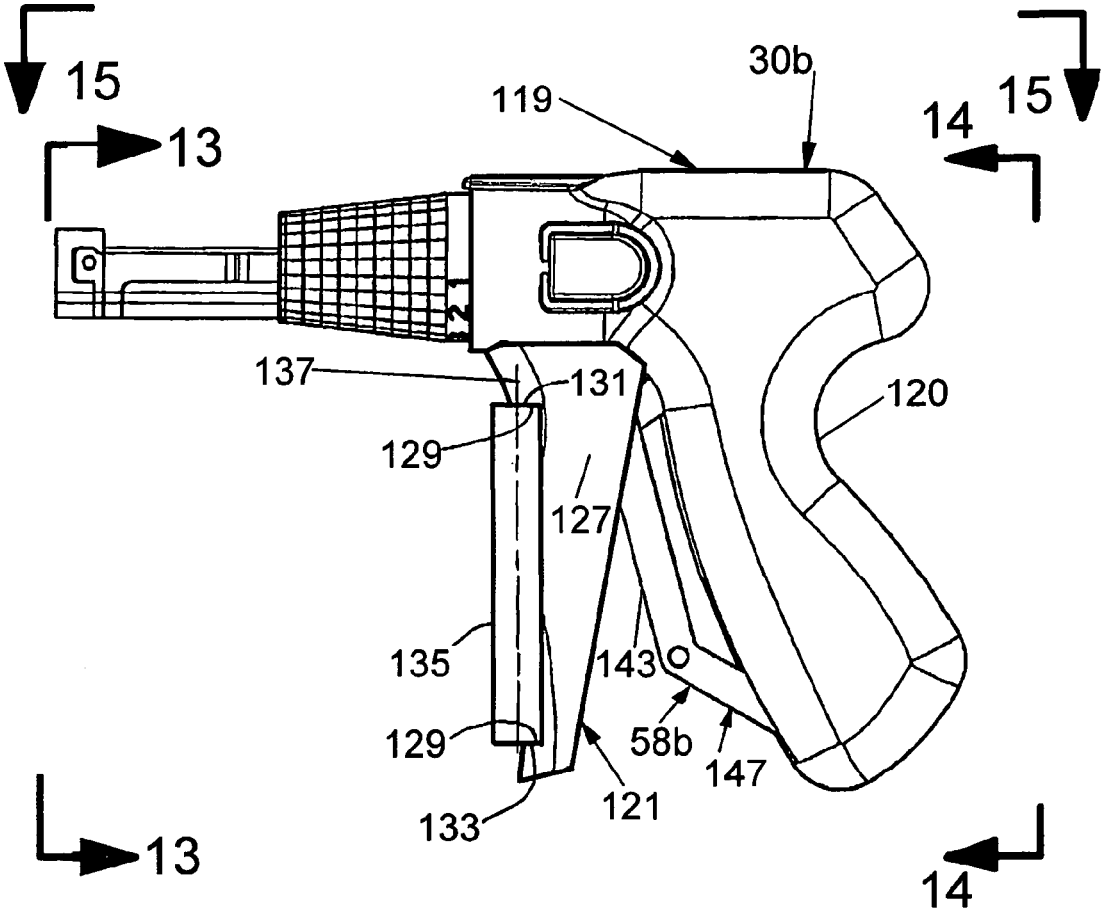
FIG. 12 is a side elevation view of an alternative third embodiment of the tool of FIG. 1, showing the trigger mechanism in the open position.
Figure 13:
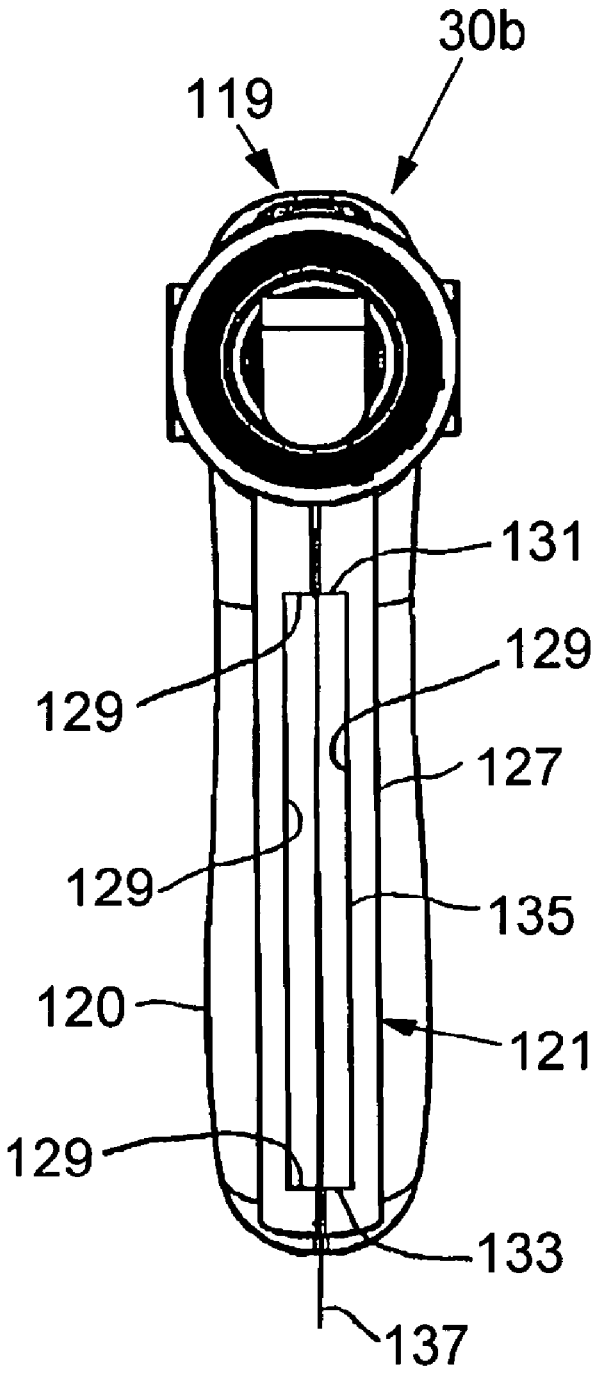
FIG. 13 is a front elevation view of the tool of FIG. 12 in the plane indicated by the line 13—13 of FIG. 12.
Figure 14:
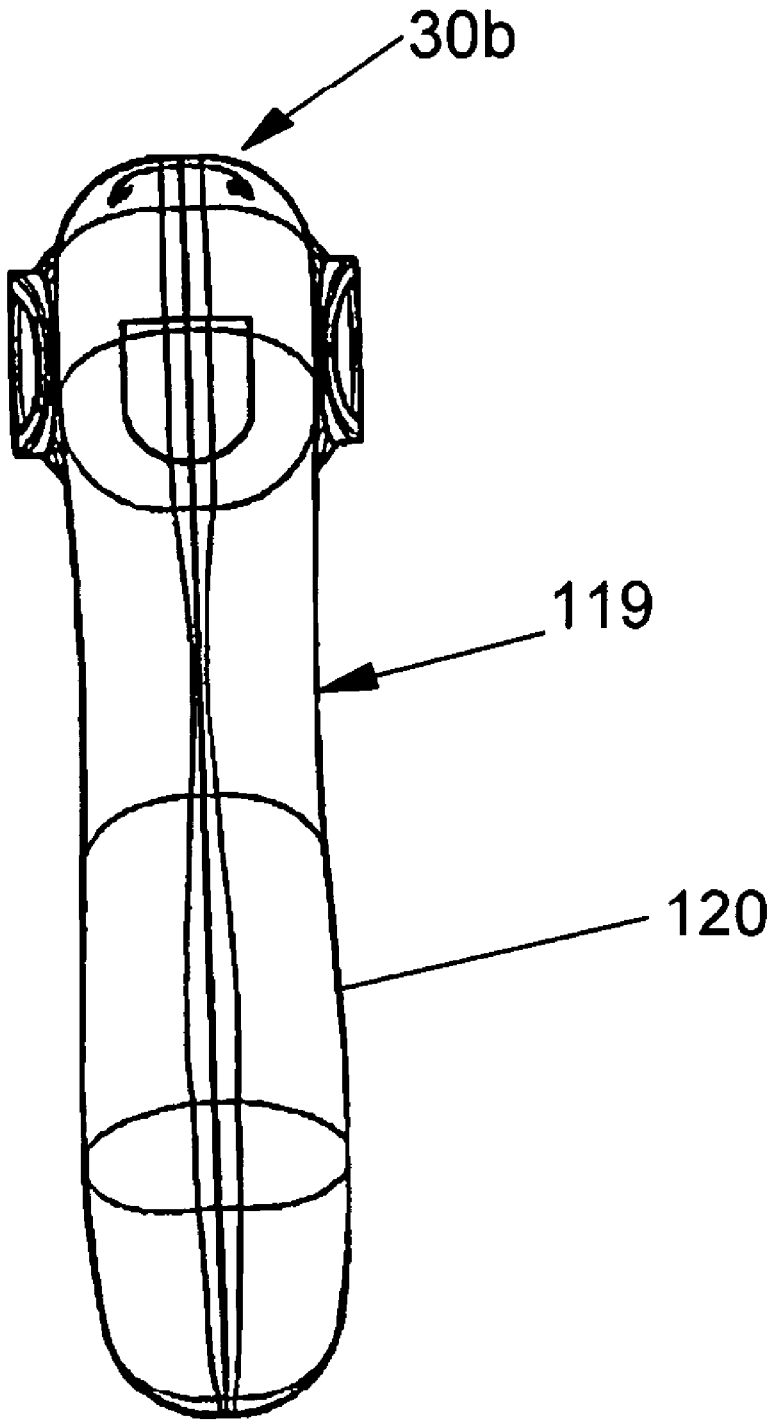
FIG. 14 is a rear elevation view of the tool of FIG. 12 in the plane indicated by the line 14—14 of FIG. 12.
Figure 18:
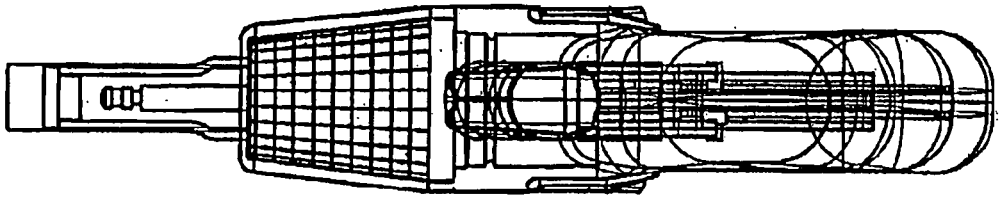
FIG. 18 is a top plan view of the tool of FIG. 16 in the plane indicated by the line 18—18 of FIG. 16.
Figure 16:
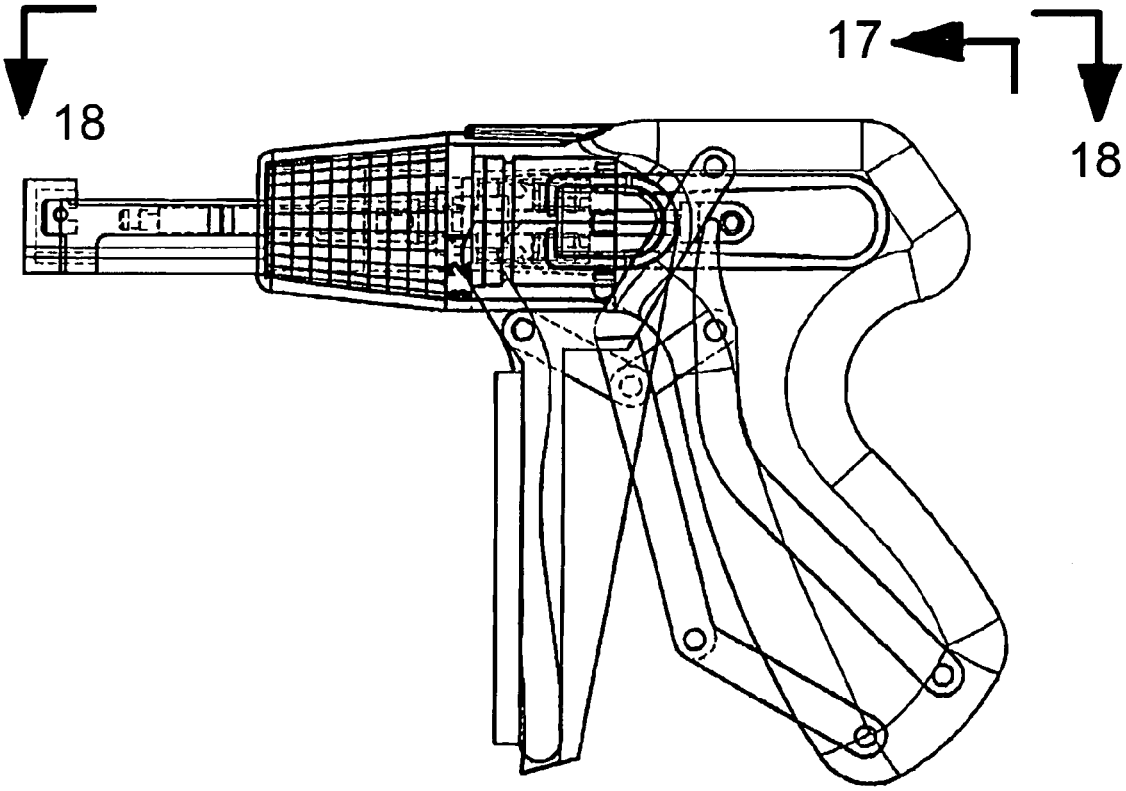
FIG. 16 is a side elevation view of the tool of FIG. 12 with portions of the outer shell of the housing being transparent to show the trigger mechanism.

The portion of the grip frame 34*a* which faces the inner and outer trigger members 58*a*, 97 has a recess 118, as shown in FIGS. 7 8, and 11.

The stop 52*a* is located between the pull rod 85*a* and inner link 109. The stop 52*a* is engaged by a portion of the finger member 75*a* between the detents 84*a* and inner link 109 when the finger member is in the open position shown in FIGS. 7 and 8.

In operation, the inner and outer trigger members 58*a*, 97 are pivoted in the directions 66*a*, 102 to the respective open positions shown in FIGS. 7 and 8. The tail of the cable tie is coupled to the distal end 88*a* of the pull rod 85*a*.

The user grasps the outer trigger member 97 and grip of the pistol-shaped housing in generally the same manner as described herein for the tool 30. The user's hand is then closed in generally the same manner as described herein for the tool 30.

The inner and outer trigger members 58*a*, 97 and links 107, 109, 111 are shaped and sized such that displacement of the outer trigger member toward the grip frame 34*a* produces a reverse sequential pivoting of the trigger members. This reverse sequential pivoting causes the displacement to produce an initial pivoting of the outer trigger member 97 relative to the inner trigger member 58*a* in an initial direction toward the closed position shown in FIG. 11. This initial direction, as shown by comparing FIGS. 8 and 11, is the pivoting direction 105 of the outer trigger member 97 relative to the inner trigger member 58*a* about the pivotal connection 100. During the initial pivoting of the outer trigger member 97, pivoting of the inner trigger member 58*a* relative to the grip frame 34*a* is substantially limited. The initial pivoting causes pivoting of the links 107, 109, 111 which, in turn, cause the finger member 75*a* to pivot in the direction 83*a* toward the closed position shown in FIG. 11. The pivoting of the finger member 75*a* in the direction 83*a* toward the closed position shown in FIG. 11 produces the axial displacement of the pull rod 85*a* in the same manner as for the tool 30 illustrated in FIGS. 1 to 6.

The reverse sequential pivoting provides for continued displacement of the outer trigger member 97 toward the grip frame 34*a* to cause subsequent pivoting of the inner trigger member 58*a* relative to the grip frame in a subsequent direction toward the closed position 68*a*. The subsequent pivoting is initiated when the outer trigger member 97 reaches the limit at which continued pivoting of the outer trigger member in the initial direction is substantially prevented. The subsequent direction is opposite from said initial direction. As shown by comparing FIGS. 8 and 11, the subsequent direction is the pivoting direction 68*a* of the inner trigger member 58*a* relative to the grip frame 34*a* about the pivotal connection 64*a*. During the subsequent pivoting, pivoting of the outer trigger member 97 relative to the inner trigger member 58*a* is substantially limited. The subsequent pivoting causes pivoting of the links 107, 109, 111 which, in turn, cause the finger member 75*a* to pivot further in the direction 83*a* toward the closed position shown in FIG. 11. The further pivoting of the finger member 75*a* toward the closed position shown in FIG. 11 produces further axial displacement of the pull rod 85*a* in the same manner as for the tool 30 illustrated in FIGS. 1 to 6.

The reverse sequential pivoting, including the initial and subsequent pivoting of the trigger members 58*a*, 97, causes the links 107, 109, 111 to pivot from the positions shown in FIG. 8 to the positions shown in FIG. 11.

Pivoting of the trigger members 97, 58*a* in the directions 105, 68*a* to the respective closed positions shown in FIG. 11 causes the links 107, 111 to pivot to positions where the links are received in the recess 118 in the grip frame 34*a*, as shown in FIG. 11. This facilitates pivoting of the trigger members 97, 58*a* in the directions 105, 68*a* to the respective closed positions shown in FIG. 11.

An advantage of the reverse sequential pivoting is that the initial pivoting of the outer trigger member 97, the portion of the member 97 most distant from the grip frame 34*a* is grasped by the smaller fingers of the user's hand since the pivoting is primarily about pivotal connections 100. Since these fingers are weaker, the force transmitted by the trigger linkage 56*a* and intermediate linkage 72*a* to the pull rod 85*a* are initially low. When the initial pivoting is nearly complete, the portion of the outer trigger member 97 most distant from the grip frame 34*a* is grasped by the larger fingers of the user's hand since the pivoting is primarily about pivotal connection 64*a*. Since these fingers are stronger, the force transmitted by the trigger linkage 56*a* and intermediate linkage 72*a* to the pull rod 85*a* increases. This is desirable because typically, as the cable tie is stretched, it becomes increasingly resistant to continued stretching.

Figure 21:
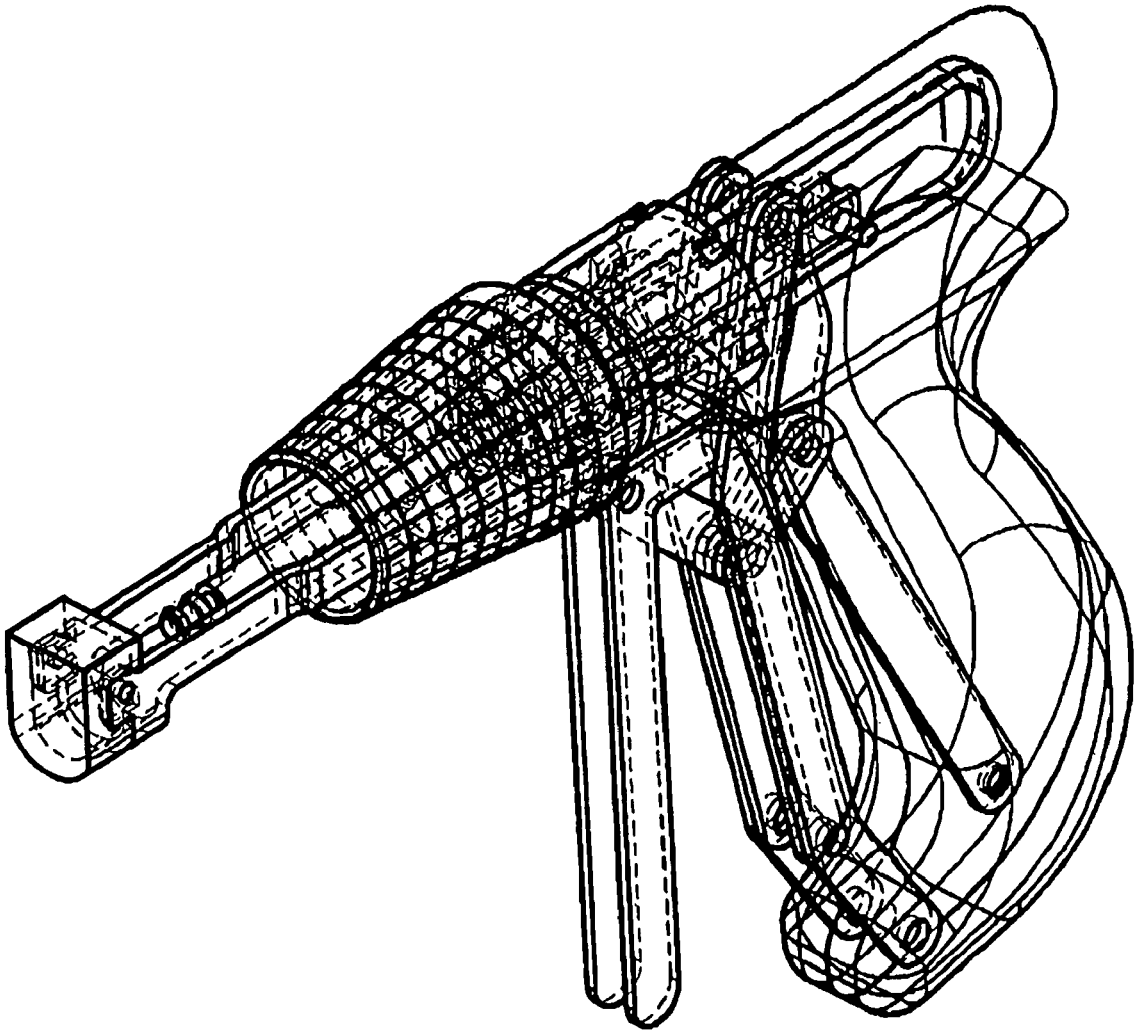
FIG. 21 is a perspective view of the tool of FIG. 12 with portions of the outer shell of the housing being transparent and removed to show the trigger mechanism, the trigger mechanism being shown in the open position.
Figure 22:
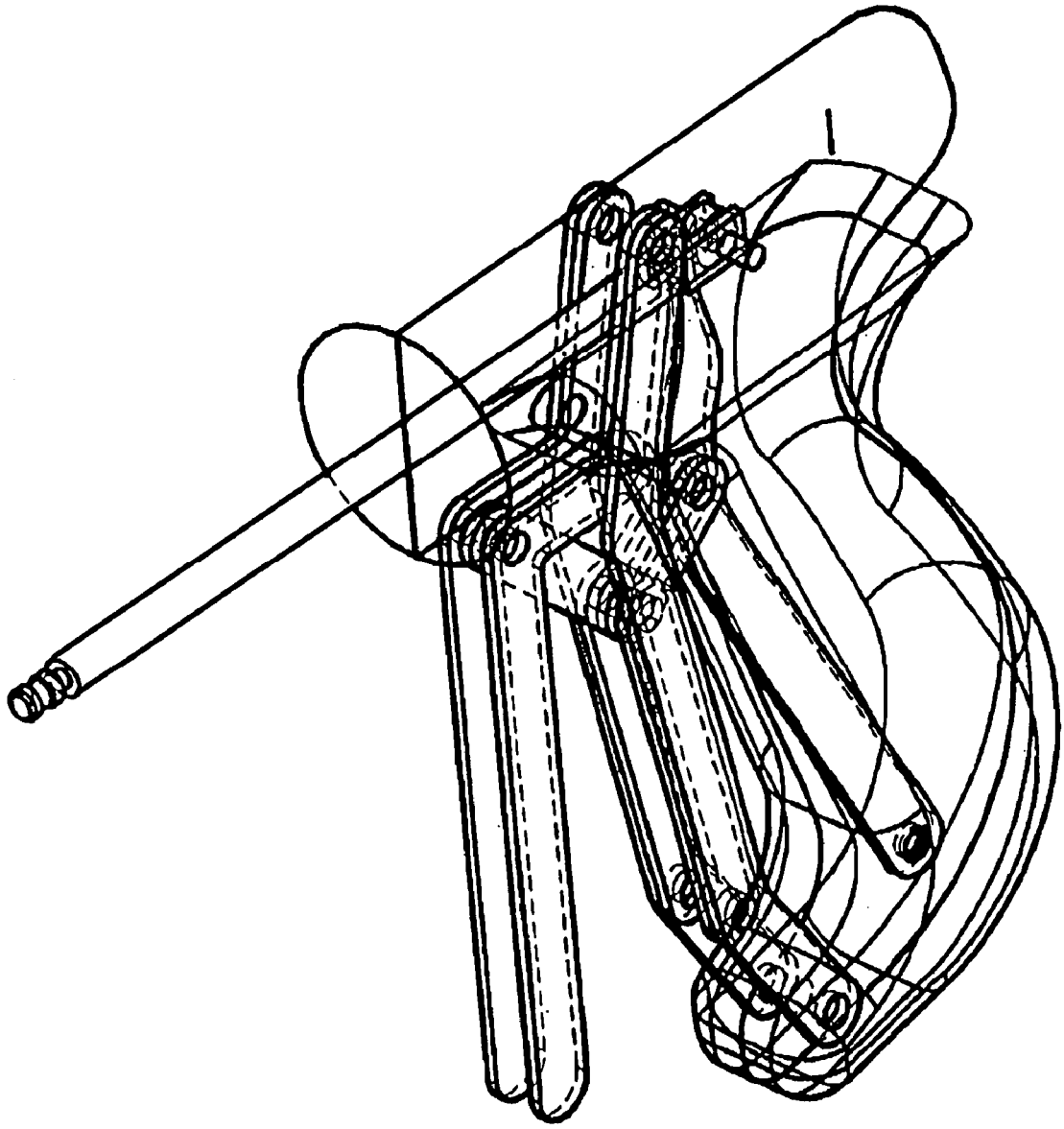
FIG. 22 is a perspective view of the tool of FIG. 21 with additional portions of the outer shell of the housing being removed to further show the housing frame and trigger mechanism.
Figure 23:
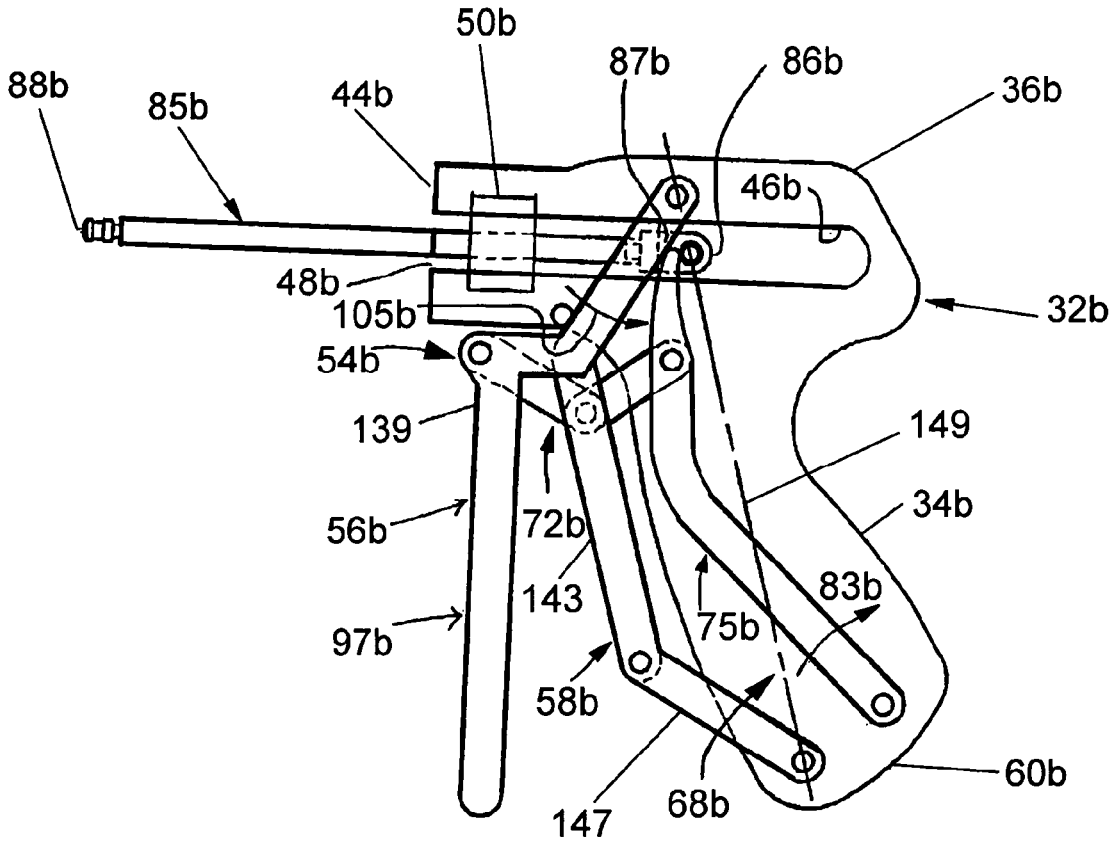
FIG. 23 is a side elevation view of the tool of FIG. 22 with the outer shell of the housing being removed, the trigger mechanism being shown in the open position.

An alternative third embodiment of the cable tie installation tool 30*c*, which is a preferred embodiment of the present invention, is shown in FIGS. 12 to 23. FIGS. 21 to 23 are views which correspond generally to the views of FIGS. 1, 2 and 6, and FIGS. 7, 8 and 11, respectively. Parts illustrated in FIGS. 21 to 23 which correspond to parts illustrated in FIGS. 1, 2 and 6, and FIGS. 7, 8 and 11 have, in FIGS. 21 to 23, the same reference numeral as in FIGS. 1, 2 and 6, and FIGS. 7, 8 and 11 with the addition of the suffix "b". The suffix "a", included in some of the reference numerals of FIGS. 7, 8 and 11, is not included in FIGS. 21 to 23, since the correspondence to such parts in FIGS. 7, 8 and 11 is sufficiently indicated by the corresponding numbers.

FIGS. 12 to 21 show the housing frame 32*b*, and additionally show the outer shell of the housing which is designated generally by the reference numeral 119. The outer shell 119 includes a shell 120 in which the housing frame 32*b* is supported. The portion of the shell body 120 in which the grip frame 34*b* is located is anatomically shaped to facilitate conformance thereto by the user's hand when the hand grasps the shell body and trigger cover 121. Such grasping may be to pivot the trigger members 97*b*, 58*b* in the directions 105*b*, 68*b* from the respective open positions shown in FIG. 23 to the respective closed positions shown in FIG. 24. To further facilitate such grasping, the outer surface of the portion of the shell body 120 which is so grasped may be formed of a soft comfortable material. FIGS. 12 to 20 also illustrate additional parts of the tool 30*b* connected, either directly or indirectly, to the housing shell 119. Some of these additional parts are disclosed in U.S. Pat. No. 5,915,425.

The outer shell 119 includes a trigger cover 121 pivotally connected to the shell body 120 such that the trigger cover is in depending relation to the barrel frame 36. The trigger cover 121 is located outwardly relative to the outer trigger member 97. The pivotal connection provides for pivoting of the trigger cover 121 from the open position shown, for example, in FIG. 19, in a direction 123 toward the closed position, and in a direction 125 toward the open position.

The trigger cover 121 includes a cover member 127 and a longitudinal window 129 formed in the cover member. The trigger cover 121 also has upper and lower flanges 131, 133 mounted on respective upper and lower ends of the window 129.

The housing includes a roller 135 having opposite ends rotatably supported by respective ones of said upper and lower flanges 131, 133. This rotatable support may be provided by the roller 135 including an axle supported between the upper and lower flanges 131, 133 and a sleeve which rotates about the axle in coaxial relation thereto.

The roller 135 has an axis of rotation 137 the orientation of which is generally the same as the longitudinal axis of the trigger cover 121. The connections between the roller 135 and upper and lower flanges 131, 133 obstructs longitudinal, transverse and lateral displacement of the roller relative to the cover member 127. The roller 135 is positioned within the window 129 such that a portion of the roller extends outwardly beyond the trigger cover 121.

The inner and outer trigger members 58*b*, 97*b* are configured as shown in FIGS. 22 and 23. More specifically, the outer trigger member 97*b* has a lower corner portion 139 and an upper inclined portion 141.

The inner trigger member 58*b* has an intermediate segment 143 between upper and lower segments 145, 147. The intermediate segment 143 is inclined relative to the upper and lower segments 145, 147 such that the intermediate segment is outward of an inner axis 149. The inner axis 149 is contained in or generally parallel to the central plane 38*b*. The inner axis 149 intersects the pivotal connections 100*b* between the inner and outer trigger members 58*b*, 97*b*. The inner axis 149 further intersects the pivotal connections 64*b* between the inner trigger member 58*b* and grip frame 34*b*.

A stop 52*b*, which may be a pin, is transversely mounted on the barrel frame 36*b*. The stop 52*b* limits the pivoting of the inner and outer trigger members 58*b*, 97*b* in the directions 66*b*, 102*b* toward the open positions shown in FIG. 23. The engagement of the members 58*b*, 97*b* with the stop 52*b* defines the open positions shown in FIG. 22.

Figure 17:
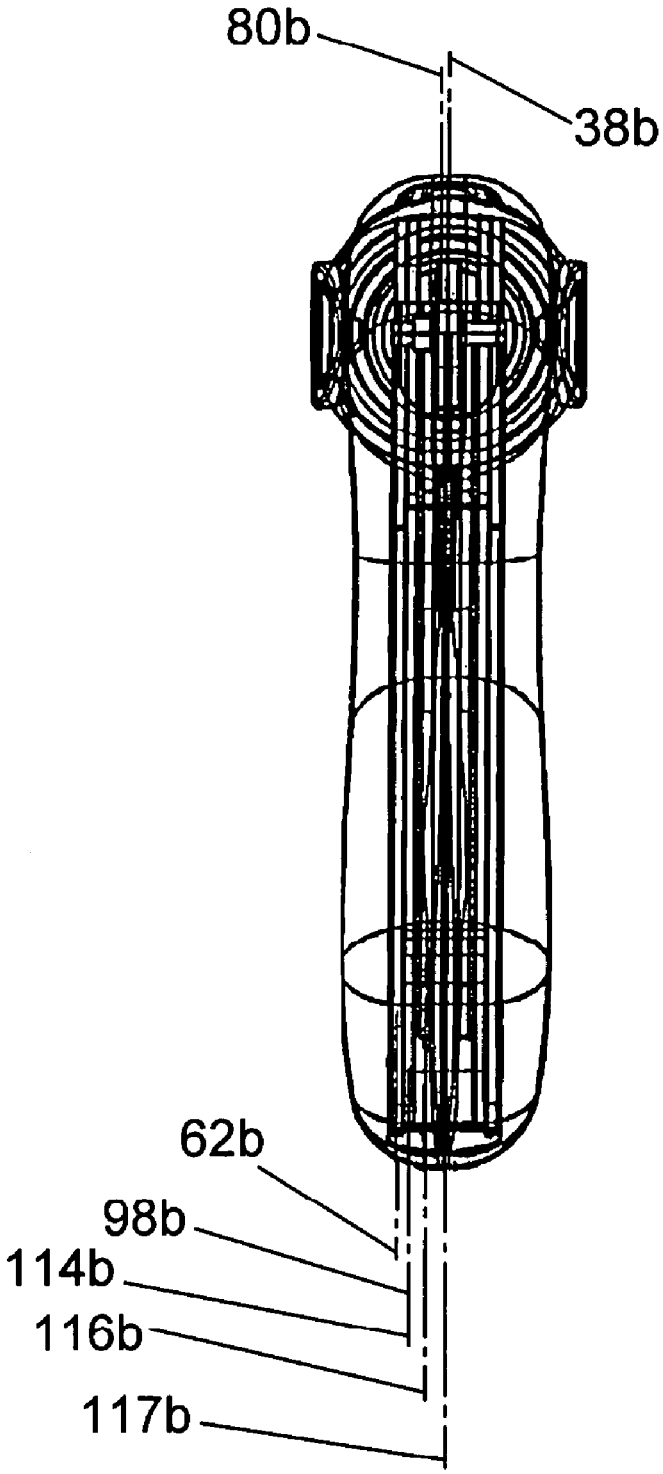
FIG. 17 is a rear elevation view of the tool of FIG. 16 in the plane indicated by the line 17—17 of FIG. 16.
Figure 19:
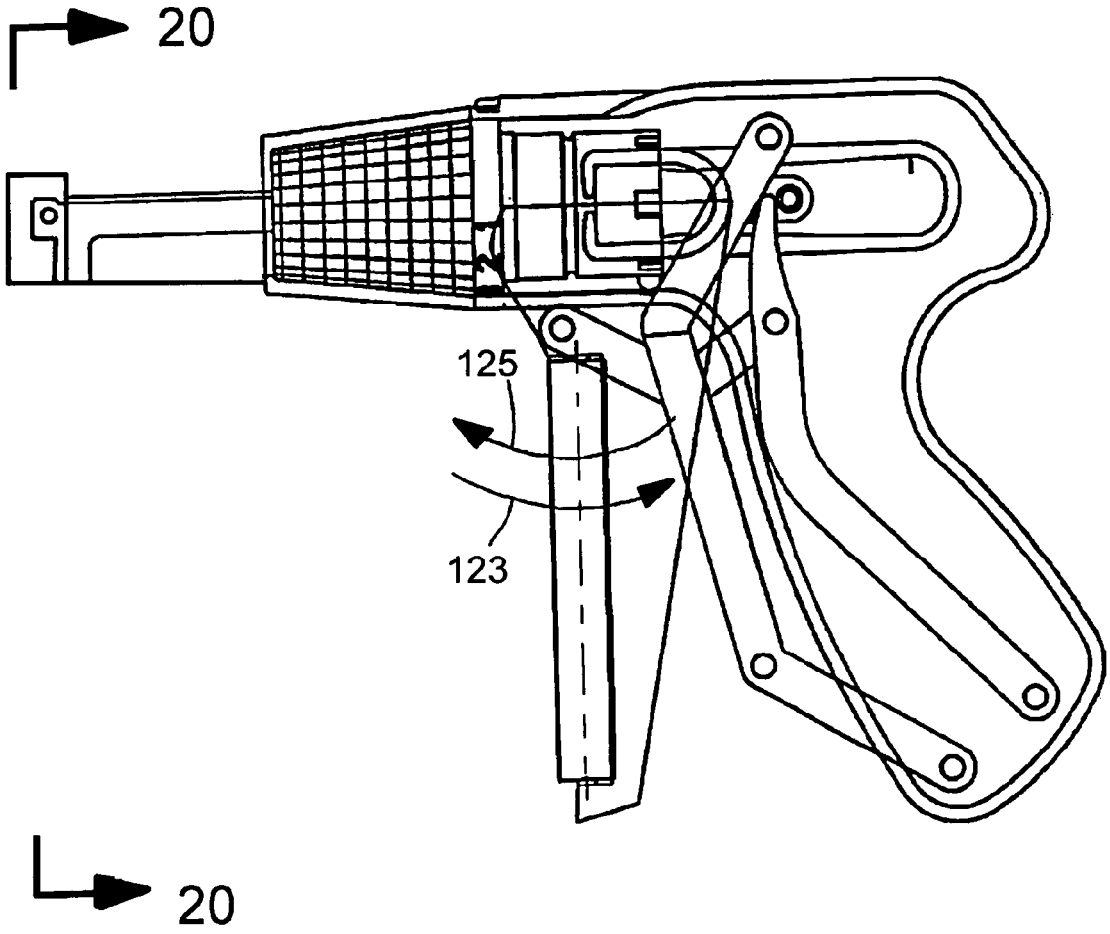
FIG. 19 is a side elevation view of the tool of FIG. 12 with the outer shell of the housing being removed and the trigger cover being transparent to show the trigger mechanism.
Figure 20:
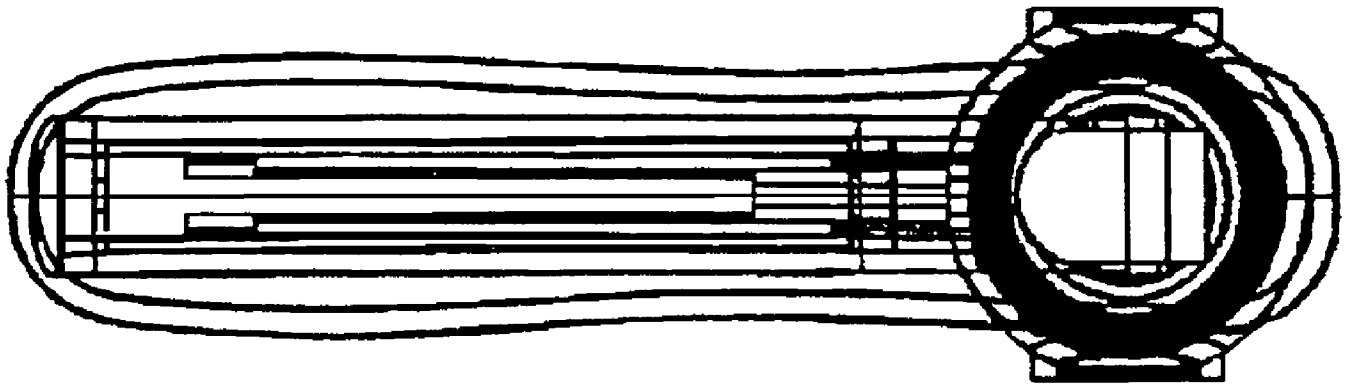
FIG. 20 is a front elevation view of the tool of FIG. 19 in the plane indicated by the line 20—20 of FIG. 19.

The outer link 111*b* has a single-member structure and a longitudinal axis 117*b* which is generally contained in the central plane 38*b*, as shown in FIG. 17. As an alternative to the single-member structure, the link 111*b* may have a dual-member structure. The longitudinal axes of the members of such a dual-member structure may be generally parallel to the central plane 38*b*.

The central link 107*b* has a dual-member structure, each member of which has a longitudinal axis which is generally parallel to the central plane 38*b*, as shown in FIG. 17. As an alternative to the dual-member structure, the link 107*b* may have a single-member structure. The longitudinal axis of such a single-member structure may be generally contained in or parallel to the central plane 38*b*.

In operation, the tool 30*b* is manipulated by the user in generally the same manner as the tool 30*a*. More specifically, the inner and outer trigger members 58*b*, 97*b* are pivoted in the directions 66*b*, 102*b* into engagement with the stop 52*b* and thereby to the open positions shown in FIG. 22. The trigger cover 121 and roller 135 are then grasped by the fingers of the user's hand, the heel of which is in abutting relation with the grip. The portion of the roller 135 extending outwardly beyond the trigger cover 121 results in at least one of the fingers of the user's hand contacting the roller. Then, the user's hand is closed to pivot the trigger cover 121 in the direction 123 toward the closed position. The contact between at least one of the fingers and the roller 135 produces lateral translation of the finger or fingers relative to the trigger cover 121 and resultant rotation of the roller. This reduces possible friction between the fingers and trigger cover 121.

Figure 24:
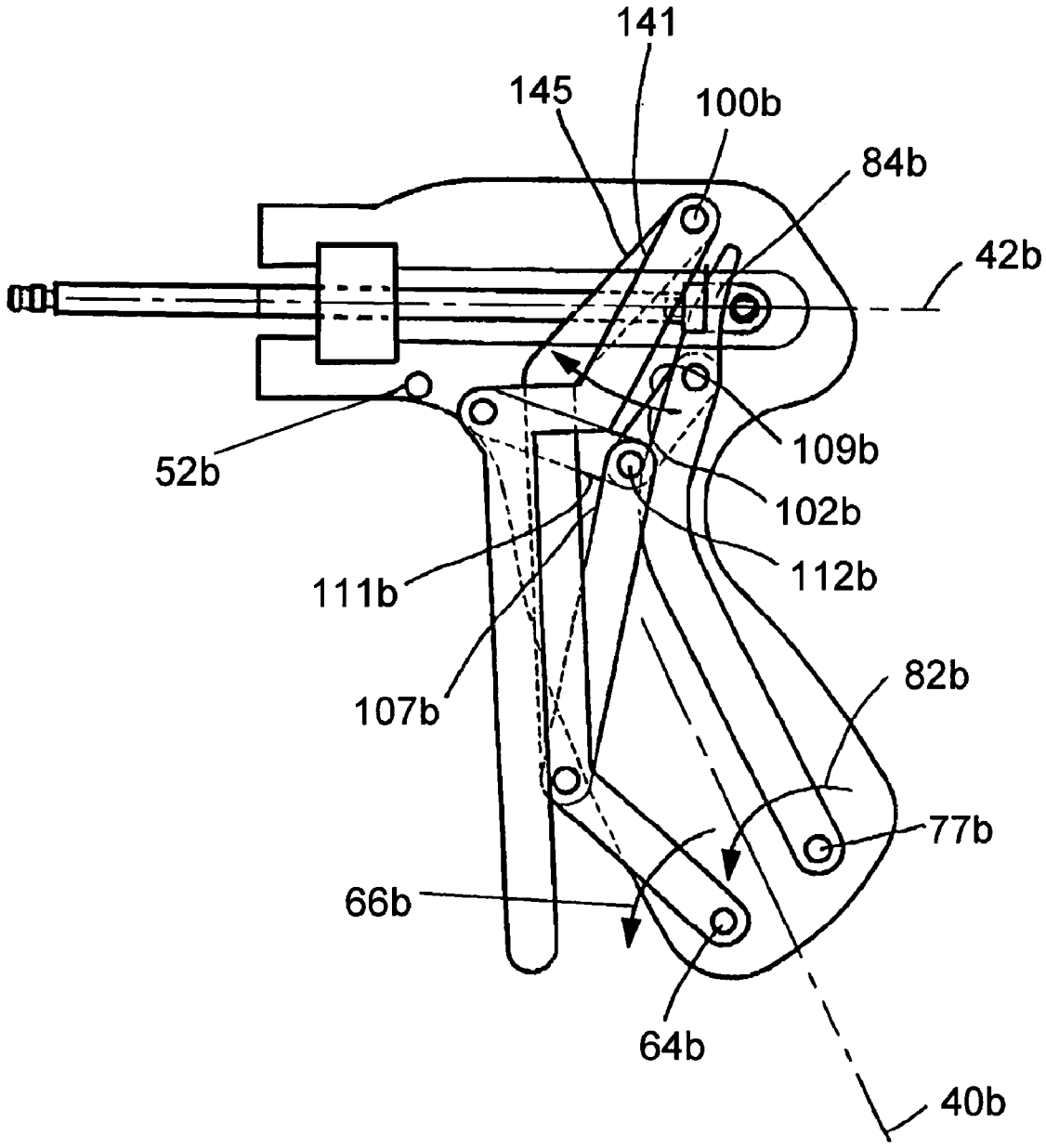
FIG. 24 is a side elevation view of the tool of FIG. 22 with the outer shell of the housing being removed, the trigger mechanism being shown in the closed position.

The outward position of the trigger cover 121 relative to the outer trigger member 97*b* results in the trigger cover, when pivoted toward the closed position 125, urging the outer trigger member to pivot in the direction 105*b* toward the closed position shown in FIG. 24. This produces reverse sequential pivoting corresponding to the reverse sequential pivoting described herein above for FIGS. 7 to 11. The resulting axial displacement force applied to the pull rod 85*b* is increased and the angular displacement required to pivot the inner and outer trigger members 97*b*, 58*b* in the directions 105*b*, 68*b* from the open positions shown in FIG. 23 to the closed positions shown in FIG. 24 is decreased, relative to the corresponding amounts for the tool 30*a*. This decrease results from the configuration of the inner and outer trigger members 58*b*, 97*b*, including the lower corner portion 139, upper inclined portion 141, intermediate segment 143, and upper and lower segments 145, 147.

Figure 25:
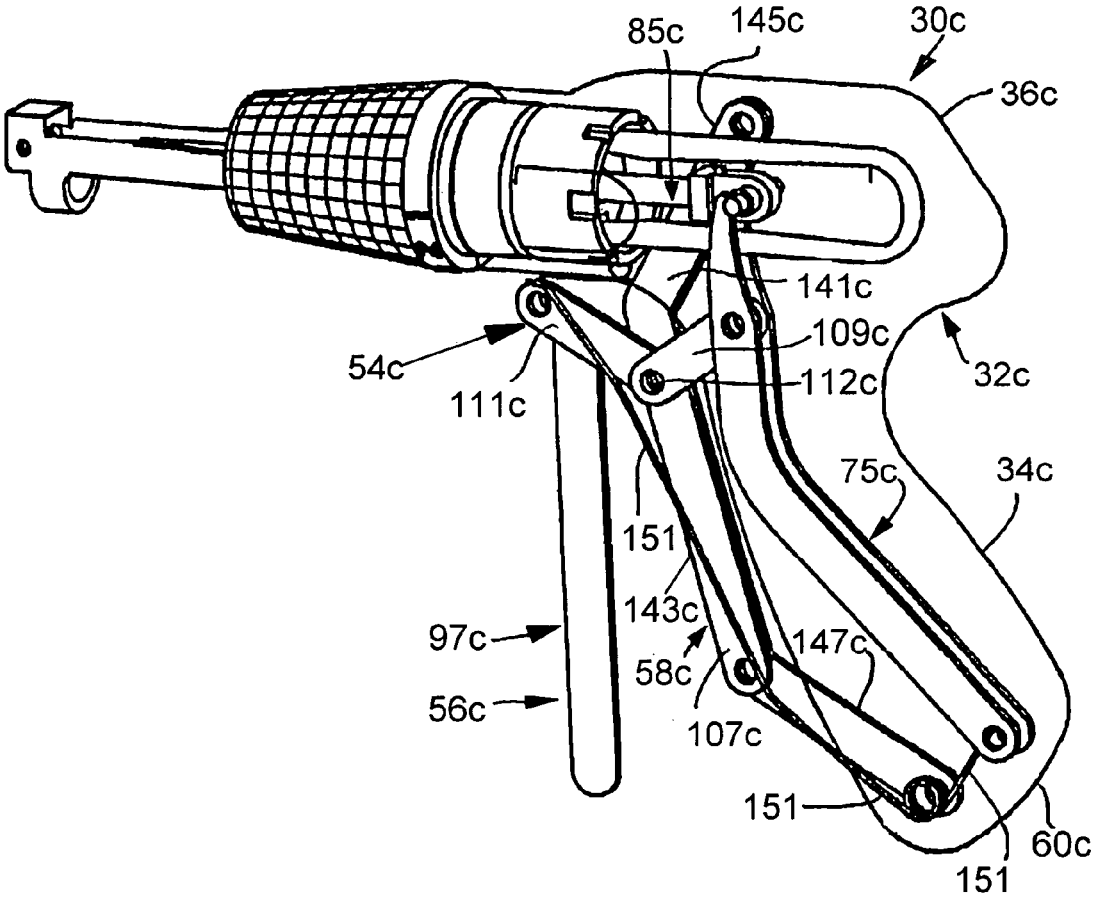
FIG. 25 is a perspective view of an alternative fourth embodiment of the tool of FIG. 1 with the housing and a portion of the trigger mechanism removed to show the return spring, the trigger mechanism being shown in the open position.
Figure 26:
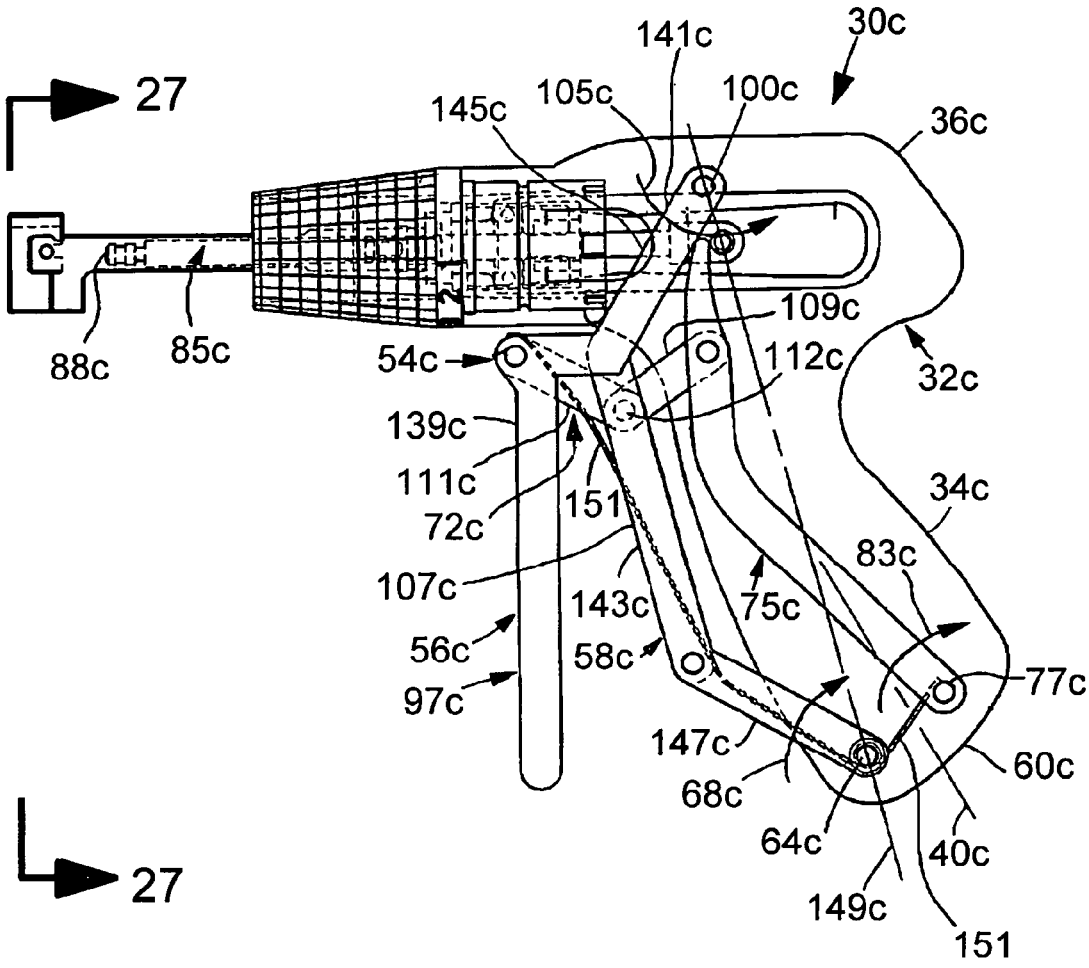
FIG. 26 is a side elevation view of the tool of FIG. 25 with the trigger mechanism being shown in the open position.
Figure 27:
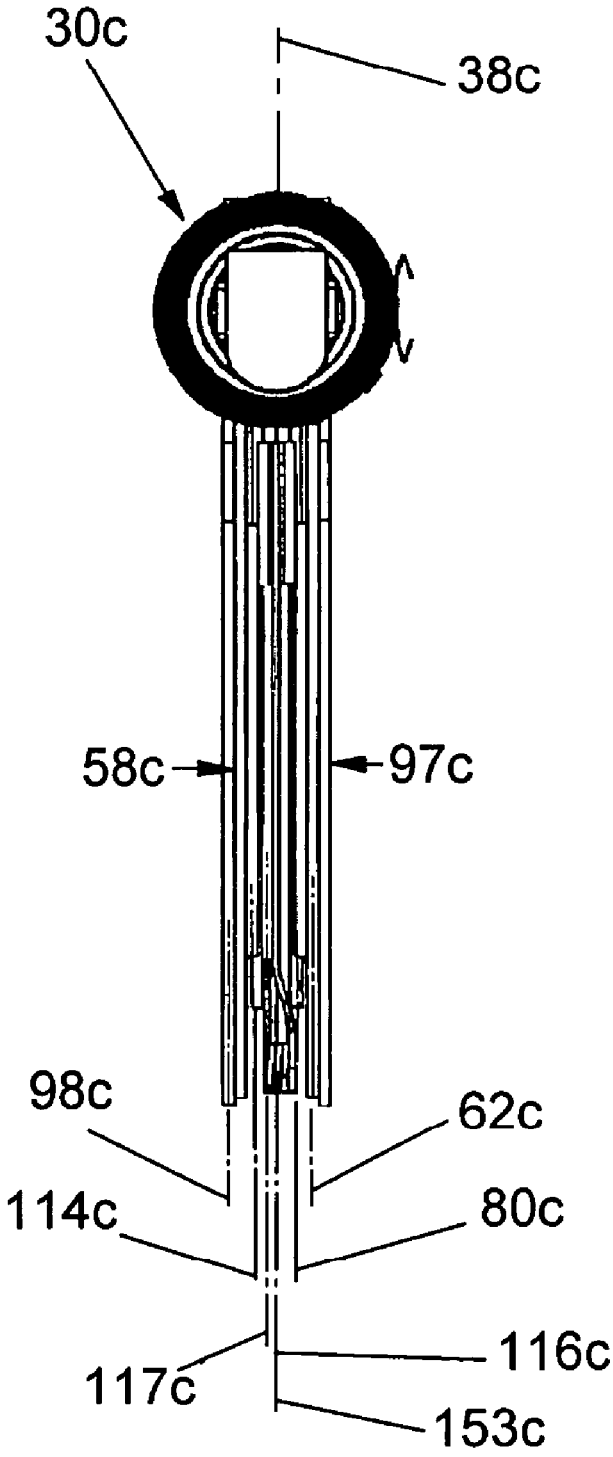
FIG. 27 is a front elevation view of the tool of FIG. 26 in the plane indicated by the line 27—27 of FIG. 26.

An alternative fourth embodiment of the tool 30*c*, which is a preferred embodiment of the present invention, is shown in FIGS. 25 to 27. FIGS. 25 to 27 are views which correspond generally to the views of FIGS. 1 to 3, FIGS. 7 to 9, and FIGS. 22, 23 and 20, respectively. Parts illustrated in FIGS. 25 to 27 which correspond to parts illustrated in FIGS. 1 to 3, FIGS. 7 to 9, and FIGS. 22, 23 and 20 have, in FIGS. 25 to 27, the same reference numeral as in FIGS. 1 to 3, FIGS. 7 to 9, and FIGS. 22, 23 and 20 with the addition of the suffix "c". The suffixes "a" and "b", included in some of the reference numerals of FIGS. 7 to 9, and FIGS. 22, 23 and 20, are not included in FIGS. 25 to 27, since the correspondence to such parts in FIGS. 7 to 9, and FIGS. 22, 23 and 20 is sufficiently indicated by the corresponding numbers.

As shown in FIG. 25, the tool 30*c* has particular correspondence to the tool 30*b* shown in FIG. 22. The tool 30*c* includes a return spring designated generally by the reference numeral 151. The return spring 151 is generally elongate and connected to the outer trigger member 97*c* generally at the intersection between the lower corner portion 139*c* and upper inclined portion 141*c*. The return spring 151 is further connected to the pivotal connection 77*c* of the conversion member 75*c* to the grip frame 34*c*. The return spring 151 has a longitudinal axis 153 generally contained in or parallel to the central plane 38*c*.

The inner link 109*c* shown in FIG. 25 has a single-member structure and a longitudinal axis 116*c* which is generally contained in the central plane 38*c*, as shown in FIG. 27. As an alternative to the single-member structure, the link 109*c* may have a dual-member structure. The longitudinal axis of the members of such a dual-member structure may be generally parallel to the central plane 38*c*.

In operation, the tool 30*c* is manipulated by the user in generally the same manner as the tool 30*b*. The return spring 151 resists pivoting of the outer trigger member 97*c* in the direction 105*c* toward the closed position of the outer trigger member.

The tools 30*a*, 30*b* shown in FIGS. 7 to 11, and FIGS. 12 to 24, respectively, may have a return spring corresponding to the return spring 151 shown in FIGS. 25 to 27. The tool 30 shown in FIGS. 1 to 6 may have a return spring connected to the trigger member 58 which resists pivoting of the trigger member in the direction 68 toward the closed position shown in FIGS. 5 and 6.

The tools 30, 30*a*, 30*c* shown in FIGS. 1 to 6, FIGS. 7 to 11, and FIGS. 25 to 27, respectively, may have an outer shell including a shell body and trigger cover, and a roller corresponding, respectively, to the outer shell 119, shell body 120, trigger cover 121, and roller 135. Such an outer shell and roller in FIGS. 1 to 6, FIGS. 7 to 11, and FIGS. 25 to 27 may operate in a manner corresponding to the operation of the outer shell 119 and roller 135.

Embodiments of the ergonomic cable tie installation tool of the present invention are disclosed in the following U.S. Design Patent Applications, the entire disclosures of which are hereby incorporated by reference herein:

Title: Cable Tie Installation Tool; Inventors: Jose Maria D. Magno, Jr., Brian A. Pope; Executed by Inventors on same date as present U.S. patent application Ser. No. 29/185,985; and Title: Cable Tie Installation Tool; Inventors: Jose Maria D. Magno, Jr., Brian A. Pope; Executed by Inventors on same date as present U.S. patent application Ser. No. 29/185,986.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A tool for the installation of a cable tie having an elongate tail, said tool comprising:

a generally pistol-shaped housing including a grip which depends from a barrel, said barrel and grip each having a respective longitudinal axis which is generally contained in or parallel to a central plane of said housing;

a trigger mechanism including a trigger linkage having an elongate trigger member which has opposite ends one of which is pivotally connected to said grip generally adjacent to a distal end thereof, said trigger member having a longitudinal axis which is generally contained in or parallel to said central plane, said pivotal connection providing for pivoting of said trigger member between open and closed positions, said trigger mechanism including an intermediate linkage connected at one end to said trigger member, said connection of said intermediate linkage to said trigger member being between said opposite ends thereof, said intermediate linkage extending into said housing; and a tensioning mechanism extending into said housing through a distal end of said barrel, said tensioning mechanism providing for coupling of another end of said intermediate linkage to the tail such that pivoting of said trigger member toward said closed position causes pivoting of said intermediate linkage resulting in said tensioning mechanism producing increased tension in the tail.

2. A tool according to claim 1, wherein said trigger member has a distal region the distance of which from said grip is greater than the distance between said pivotal connection and said grip when said trigger member is in said open position.

3. A tool according to claim, and further comprising a return spring connected to said trigger linkage and intermediate linkage such that said return spring resists pivoting of said trigger member toward said closed position.

4. A tool for the installation of a cable tie having an elongate tail, said tool comprising:

a generally pistol-shaped housing including a grip which depends from a barrel; said barrel and grip each having a respective longitudinal axis which is generally contained in or parallel to a central plane of said housing;

a trigger mechanism including a trigger linkage having an elongate trigger member one end of which is pivotally connected to said grip generally adjacent to a distal end thereof, said trigger member having a longitudinal axis which is generally contained in or parallel to said central plane, said pivotal connection providing for pivoting of said trigger member between open and closed positions;

said trigger mechanism including an intermediate linkage connected at one end to said trigger member, said intermediate linkage extending into said housing; and a tensioning mechanism extending into said housing through a distal end of said barrel, said tensioning mechanism providing for coupling of another end of said intermediate linkage to the tail such that pivoting of said trigger member toward said closed position causes pivoting of said intermediate linkage resulting in said tensioning mechanism producing increased tension in the tail, wherein said intermediate linkage comprises a finger member positioned within said housing, said finger member having one end pivotally connected to said grip generally adjacent to said distal end thereof, the other end of said finger member being coupled to said tensioning mechanism, said finger member having a longitudinal axis which is generally contained in or parallel to said central plane, said pivotal connection providing for pivoting of said finger member between open and closed positions, said coupling between said finger member and tensioning mechanism producing said increased tension in the tail when said finger member is pivoted toward said closed position.

5. A tool according to claim 4, and further comprising a stop fixed to said barrel such that said stop is engaged by said finger member when said finger member is in said open position, said stop preventing pivoting of said finger member beyond said open position.

6. A tool according to claim 4, wherein said intermediate linkage further comprises an elongate intermediate link having one end pivotally connected to said finger member, the other end of said intermediate link being pivotally connected to said trigger member, said pivotal connections of said intermediate link being offset from one another such that the intermediate link is inclined relative to said trigger and finger members wherein pivoting of said trigger member toward said closed position causes said intermediate link to pivot relative to said trigger and finger members resulting in said finger member pivoting toward said closed position.

7. A tool according to claim 6, wherein said pivotal connection of said intermediate link to said finger member is closer to said barrel as compared to said pivotal connection of said intermediate link to said trigger member.

8. A tool according to claim 1 for the installation of a cable tie having an elongate tail, said tool comprising:

a generally pistol-shaped housing including a grip which depends from a barrel; said barrel and grip each having a respective longitudinal axis which is generally contained in or parallel to a central plane of said housing:

a trigger mechanism including a trigger linkage having an elongate trigger member one end of which is pivotally connected to said grip generally adjacent to a distal end thereof, said trigger member having a longitudinal axis which is generally contained in or parallel to said central plane, said pivotal connection providing for pivoting of said trigger member between open and closed positions;

said trigger mechanism including an intermediate linkage connected at one end to said trigger member, said intermediate linkage extending into said housing; and a tensioning mechanism extending into said housing through a distal end of said barrel, said tensioning mechanism providing for coupling of another end of said intermediate linkage to the tail such that pivoting of said trigger member toward said closed position causes pivoting of said intermediate linkage resulting in said tensioning mechanism producing increased tension in the tail, wherein said trigger member defines an inner trigger member, said trigger linkage further including an elongate outer trigger member one end of which is pivotally connected to the end of said trigger member opposite said one end thereof, said outer trigger member having a longitudinal axis which is generally contained in or parallel to said central plane, said pivotal connection of said outer trigger member providing for pivoting thereof between open and closed positions such that pivoting of said outer trigger member toward said closed position causes the pivoting of said intermediate linkage.

9. A tool according to claim 8 wherein said trigger members and intermediate linkage are shaped and sized such that displacement of said outer trigger member toward said grip produces a reverse sequential pivoting of said trigger members wherein said displacement produces an initial pivoting of said outer trigger member relative to said inner trigger member in an initial direction toward said closed position, said initial pivoting causing pivoting of said intermediate linkage to cause said tensioning mechanism to produce said increased tension in the tail, said reverse sequential pivoting providing for continued displacement of said outer trigger member toward said grip causing subsequent pivoting of said inner trigger member relative to said grip in a subsequent direction toward said closed position, said subsequent direction being opposite from said initial direction, said subsequent pivoting causing pivoting of said intermediate linkage resulting in said tensioning mechanism producing the increased tension in the tail.

10. A tool according to claim 9, wherein said trigger members and intermediate linkage are shaped and sized such that pivoting of said inner trigger member relative to said grip is substantially limited during said initial pivoting, said initial pivoting of said outer trigger member relative to said inner trigger member being limited such that reaching said limit substantially prevents continued pivoting of said outer trigger member in said initial direction and causes initiation of said subsequent pivoting, pivoting of said outer trigger member relative to said inner trigger member being substantially limited during said subsequent pivoting.

11. A tool according to claim 8, and further comprising a stop fixed to said barrel such that said stop is engaged by said inner and outer trigger members when said trigger members are in said respective open positions, said stop preventing pivoting of said inner and outer trigger members beyond said respective open positions.

12. A tool according to claim 8, wherein said intermediate linkage comprises a finger member positioned within said housing, said finger member having one end pivotally connected to said grip generally adjacent to said distal end thereof, the other end of said finger member being coupled to said tensioning mechanism, said finger member having a longitudinal axis which is generally contained in or parallel to said central plane, said pivotal connection providing for pivoting of said finger member between open and closed positions, said coupling between said finger member and tensioning mechanism producing said increased tension in the tail when said finger member is pivoted toward said closed position.

13. A tool according to claim 12, wherein said intermediate linkage comprises a central link and inner and outer links, said central link having one end pivotally connected to said inner trigger member, said inner link having one end pivotally connected to said finger member, the other end of said inner link being pivotally connected to said central link, said outer link having one end pivotally connected to said outer trigger member, the other end of said outer link being pivotally connected to said other ends of said central and inner links, each of said links having a longitudinal axis each of which is generally contained in or parallel to said central plane, said links having a generally Y-shaped configuration when said trigger members are each in said respective open positions.

14. A tool according to claim 13 wherein said grip has an inner surface which faces said inner trigger member, said inner surface having a recess into which portions of said central and inner lateral links are received when said trigger members are pivoted to said respective closed positions.

15. A tool according to claim 8, and further comprising a return spring connected to said outer trigger member and intermediate linkage such that said return spring resists pivoting of said outer trigger member toward said closed position.

16. A tool according to claim 15, wherein said return spring is generally elongate and has a longitudinal axis generally contained in or parallel to said central plane.

17. A tool according to claim 8, wherein said outer trigger member has a lower corner portion and an upper inclined portion, said inner trigger member having an intermediate segment between upper and lower segments, said intermediate segment being inclined relative to said upper and lower segments such that said intermediate segment is outward of an inner axis, said inner axis being generally contained in or parallel to said central plane, said inner axis intersecting said pivotal connection between said inner and outer trigger members, said inner axis further intersecting said pivotal connection between said inner trigger member and grip.

18. A tool according to claim 17, and further comprising a generally elongate return spring connected to said outer trigger member generally at the intersection between said lower corner portion and upper inclined portion, said return spring being further connected to said pivotal connection of said finger member to said grip, said return spring having a longitudinal axis generally contained in or parallel to said central plane such that said return spring resists pivoting of said outer trigger member toward said closed position.

19. A tool according to claim 8 wherein said housing comprises an outer shell including a shell body in which said barrel and grip are supported, said outer shell further comprising a trigger cover pivotally connected to said shell body such that said trigger cover is in depending relation to said barrel, said pivotal connection providing for pivoting of said trigger cover between open and closed positions, said trigger cover being located outwardly relative to said outer trigger member such that pivoting of said trigger cover toward said closed position causes said trigger cover to contact said outer trigger member urging said outer trigger member to pivot to said closed position.

20. A tool according to claim 19 wherein said housing comprises a roller rotatably supported by said trigger cover such that a portion of said roller extends outwardly beyond said trigger cover, said roller having an axis of rotation the orientation of which is generally the same as a longitudinal axis of said trigger cover, said roller being rotated by at least one of the fingers of the user's hand when the user's hand is closed to pivot said trigger cover to said closed position.

21. A tool according to claim 20 wherein said trigger cover comprises a cover member and a longitudinal window formed in said cover member, said trigger cover further comprising upper and lower flanges mounted on respective upper and lower ends of said window, said roller having opposite ends connected to respective ones of said upper and lower flanges to allow said rotation of said roller, said connection of said roller to said flanges positioning said roller generally within said window and obstructing longitudinal, transverse and lateral displacement of said roller relative to said cover member.

22. A method for operating a tool for installing a cable tie having an elongate tail, the tool having a generally pistol-shaped housing including a grip which depends from a barrel, the barrel and grip each having a respective longitudinal axis which are generally contained in or parallel to a central plane of the housing, a trigger mechanism including a an elongate trigger member one end of which is pivotally connected to the grip generally adjacent to a distal end thereof, the trigger member having a longitudinal axis which is generally contained in or parallel to the central plane, the pivotal connection providing for pivoting of the trigger member between open and closed positions, the trigger mechanism including an intermediate linkage connected at one end to the trigger member, the intermediate linkage extending into the housing; and a tensioning mechanism extending into the housing through a distal end of the barrel, the tensioning mechanism providing for coupling of another end of the intermediate linkage to the tail, said method comprising:

pivoting the trigger member to the open position;

positioning the tool such that the distal end of the barrel is adjacent to the tail;

coupling the tail to the tensioning mechanism;

grasping the trigger member and grip such that the fingers of the user's hand partially encircle the trigger member and the heel of the user's hands abuts the grip, the fingers being oriented along the trigger member so that the smaller fingers are between the larger fingers and pivotal connection; and closing the user's hand to cause the trigger member to pivot to the closed position wherein the travel of the larger fingers toward the grip is greater than the travel of the smaller fingers toward the grip, the pivoting of the trigger member toward the closed position causing pivoting of the intermediate linkage resulting in the tensioning mechanism producing increased tension in the tail.

23. A method for operating a tool for installing a cable tie having an elongate tail, the tool having a generally pistol-shaped housing including a grip which depends from a barrel, the barrel and grip each having a respective longitudinal axis which are generally contained in or parallel to a central plane of the housing, a trigger mechanism including an elongate inner trigger member one end of which is pivotally connected to the grip generally adjacent to a distal end thereof, the inner trigger member having a longitudinal axis which is generally contained in or parallel to the central plane, the pivotal connection providing for pivoting of the inner trigger member between open and closed positions, the trigger mechanism including an elongate outer trigger member one end of which is pivotally connected to the end of the inner trigger member opposite the one end thereof, the outer trigger member having a longitudinal axis which is generally contained in or parallel to the central plane, the pivotal connection of the outer trigger member providing for pivoting thereof between open and closed positions, the trigger mechanism including an intermediate linkage connected at one end to the trigger member, the intermediate linkage extending into the housing; and a tensioning mechanism extending into the housing through a distal end of the barrel, the tensioning mechanism providing for coupling of another end of the intermediate linkage to the tail, said method comprising:

pivoting the trigger members to the respective open positions;

positioning the tool such that the distal end of the barrel is adjacent to the tail;

coupling the tail to the tensioning mechanism;

grasping the outer trigger member and grip such that the fingers of the user's hand partially encircle the outer trigger member and the heel of the user's hand abuts the grip; and closing the user's hand to cause the trigger members to pivot toward the closed positions resulting in pivoting of the intermediate linkage causing the tensioning mechanism to produce increased tension in the tail.

24. A method according to claim 23, wherein said step of closing the user's hand comprises a reverse sequential pivoting step comprising:

an initial pivoting of the outer trigger member relative to the inner trigger member in an initial direction toward the closed position, and continued displacement of the outer trigger member toward the grip to produce a subsequent pivoting of the inner trigger member relative to the grip in a subsequent direction toward the closed position, the subsequent direction being opposite from the initial direction, the pivoting of the trigger members causing the pivoting of the intermediate linkage.

25. A method according to claim 23, wherein said step of closing the user's hand comprises displacement of the outer trigger member toward the grip in a generally linear direction relative thereto, the pivoting of the trigger members to the respective closed positions causing the pivoting of the intermediate linkage.

26. A method according to claim 23, wherein the grip has a recess in the surface thereof facing the trigger members, said step of closing the user's hand comprises displacing the trigger members sufficiently so that a portion of the intermediate linkage is received in the recess.

* * * * *